US010030956B2

(12) United States Patent
Peterson, Sr. et al.

(10) Patent No.: US 10,030,956 B2
(45) Date of Patent: Jul. 24, 2018

(54) MUZZLELOADER SYSTEMS

(71) Applicant: VISTA OUTDOOR OPERATIONS LLC, Farmington, UT (US)

(72) Inventors: Bryan P. Peterson, Sr., Isanti, MN (US); Drew L. Goodlin, Isanti, MN (US); Erik K. Carlson, Oak Grove, MN (US); Lawrence P. Head, Cambridge, MN (US); John W. Swenson, Ham Lake, MN (US); Sharon Jones, Dayton, MN (US)

(73) Assignee: Vista Outdoor Operations LLC, Farmington, UT (US)

( * ) Notice: Subject to any disclaimer, the term of this patent is extended or adjusted under 35 U.S.C. 154(b) by 0 days.

(21) Appl. No.: 15/426,885

(22) Filed: Feb. 7, 2017

(65) Prior Publication Data

US 2017/0307347 A1 Oct. 26, 2017

Related U.S. Application Data

(63) Continuation of application No. 14/869,619, filed on Sep. 29, 2015, now Pat. No. 9,562,754, which is a (Continued)

(51) Int. Cl.
*F42B 3/00* (2006.01)
*F42B 30/02* (2006.01)
(Continued)

(52) U.S. Cl.
CPC ..... *F42B 30/02* (2013.01); *F41A 3/58* (2013.01); *F41A 9/375* (2013.01); *F41C 7/11* (2013.01);
(Continued)

(58) Field of Classification Search
CPC .... F41C 9/08; F41C 7/11; F42B 12/00; F41A 3/58; F41A 9/375
(Continued)

(56) References Cited

U.S. PATENT DOCUMENTS 39,112 A 7/1863 Berney
40,153 A * 10/1863 Billings ..... F42B 14/02 102/525
(Continued)

*Primary Examiner* — Samir Abdosh
(74) *Attorney, Agent, or Firm* — Christensen, Fonder, Dardi & Herbert PLLC

(57) ABSTRACT

Muzzleloader systems include a pre-packaged propellant charge and primer for providing efficient loading and unloading of the muzzleloader. The muzzleloader accepts in the breech end the propellant containment vessel that abuts against a constriction portion with a reduced diameter portion. The propellant containment vessel having an end portion with a tapered surface that conforms to the constriction portion surface. A projectile is inserted in the muzzle end and seats against the constriction portion. The propellant containment vessel may be received in a removable breech plug. The constriction portion may be part of the breech plug or a separate component secured in the barrel by way of the breech plug. The containment vessel further comprises a primer mechanism that may be integrated into the proximal end of the containment vessel.

18 Claims, 16 Drawing Sheets

Related U.S. Application Data continuation-in-part of application No. 14/041,648, filed on Sep. 30, 2013, now Pat. No. 9,146,086, and a continuation-in-part of application No. 14/041,951, filed on Sep. 30, 2013, now abandoned, said application No. 14/869,619 is a continuation-in-part of application No. 14/041,452, filed on Sep. 30, 2013, now Pat. No. 9,329,003.

(60) Provisional application No. 61/707,520, filed on Sep. 28, 2012, provisional application No. 62/096,660, filed on Dec. 24, 2014, provisional application No. 61/852,480, filed on Mar. 15, 2013, provisional application No. 61/802,264, filed on Mar. 15, 2013.

(51) Int. Cl.

| | |
|---|---|
| ***F42B 5/38*** | (2006.01) |
| ***F42B 8/04*** | (2006.01) |
| ***F41A 3/58*** | (2006.01) |
| ***F41A 9/37*** | (2006.01) |
| ***F41C 7/11*** | (2006.01) |
| ***F41C 9/08*** | (2006.01) |
| ***F42B 14/02*** | (2006.01) |
| ***F42B 14/06*** | (2006.01) |
| ***F42B 5/24*** | (2006.01) |
| ***F42B 12/76*** | (2006.01) |
| ***F42B 14/04*** | (2006.01) |

(52) U.S. Cl.

CPC ..... *F41C 9/08* (2013.01); *F41C 9/085* (2013.01); *F42B 5/24* (2013.01); *F42B 5/38* (2013.01); *F42B 8/04* (2013.01); *F42B 12/76* (2013.01); *F42B 14/02* (2013.01); *F42B 14/04* (2013.01); *F42B 14/064* (2013.01)

(58) Field of Classification Search

USPC ..... 42/51; 89/1.3; 102/430

See application file for complete search history.

(56) References Cited

U.S. PATENT DOCUMENTS 1,559,183 A 10/1925 Rimailho
1,850,034 A 3/1932 Samaia
2,383,053 A * 8/1945 Fanger ..... F42B 10/06 102/372
2,389,846 A 11/1945 Ericson
2,683,416 A 7/1954 Keller et al.
3,349,711 A * 10/1967 Darigo ..... F42B 12/80 102/509
3,583,087 A 6/1971 Huebner
3,726,231 A 4/1973 Kelly et al.
3,762,332 A * 10/1973 Witherspoon ..... F42B 14/064 102/523
3,780,464 A * 12/1973 Anderson ..... F41A 3/74 42/51
4,126,954 A 11/1978 Plummer
4,137,663 A 2/1979 Farber
4,227,330 A * 10/1980 Chapin ..... F41A 21/12 42/51
4,232,468 A 11/1980 Chapin
4,239,006 A 12/1980 Kelson
4,437,249 A 3/1984 Brown et al.
4,503,777 A * 3/1985 Young ..... F42B 12/80 102/507
4,815,682 A 3/1989 Feldmann et al.
4,918,849 A 4/1990 Spota
5,033,386 A * 7/1991 Vatsvog ..... F42B 5/307 102/430
5,127,179 A 7/1992 Marsh
5,307,583 A 5/1994 Mahn et al.
5,339,743 A * 8/1994 Scarlata ..... F42B 7/10 102/439
5,388,522 A 2/1995 Martwick et al.
5,458,064 A 10/1995 Kearns
5,487,232 A 1/1996 Osborne et al.
5,623,779 A 4/1997 Rainey, III
5,642,583 A 7/1997 Ball et al.
5,651,203 A 7/1997 Knight
5,706,598 A 1/1998 Johnston
5,708,231 A * 1/1998 Koon ..... F42B 5/067 102/430
5,777,256 A 7/1998 Simon et al.
5,822,904 A 10/1998 Beal
6,085,454 A 7/2000 Caudle
6,145,235 A 11/2000 Emerson et al.
6,216,380 B1 4/2001 McGarity, Jr. et al.
6,314,670 B1 11/2001 Rodney, Jr.
6,385,887 B1 5/2002 Johnston
6,782,830 B1 8/2004 Candland et al.
6,796,068 B2 9/2004 Crowson et al.
6,895,865 B2 * 5/2005 Bond ..... F41C 9/085 102/364
7,201,104 B2 4/2007 McMurray et al.
7,219,607 B2 5/2007 Oertwig
7,380,505 B1 6/2008 Shiery
7,451,705 B2 11/2008 Fry
7,621,064 B2 11/2009 Laney et al.
7,726,245 B2 6/2010 Quesenberry et al.
7,877,919 B2 2/2011 Richards
8,132,348 B1 3/2012 Post
9,146,086 B2 * 9/2015 Peterson ..... F41A 3/00
2002/0035800 A1 3/2002 Lewis
2002/0129531 A1 9/2002 Camp
2004/0050285 A1 3/2004 Zozulya et al.
2005/0005807 A1 1/2005 Wiley et al.
2005/0016050 A1 1/2005 Howell, Jr.
2005/0183318 A1 8/2005 McGivern
2006/0027128 A1 2/2006 Hober
2006/0027130 A1 2/2006 Parker
2006/0027131 A1 2/2006 Byer
2006/0086029 A1 4/2006 Kirkpatrick
2008/0282596 A1 11/2008 Deleeuw
2010/0126370 A1 5/2010 O'Dwyer
2011/0296729 A1 12/2011 Overstreet
2012/0090492 A1 4/2012 Rebar
2012/0180687 A1 7/2012 Padgett et al.
2012/0260814 A1 10/2012 Worrell et al.
2014/0090284 A1 4/2014 Peterson et al.
2014/0090285 A1 4/2014 Peterson et al.
2014/0130699 A1 5/2014 Peterson et al.
2014/0318402 A1 10/2014 Carlson et al.

* cited by examiner

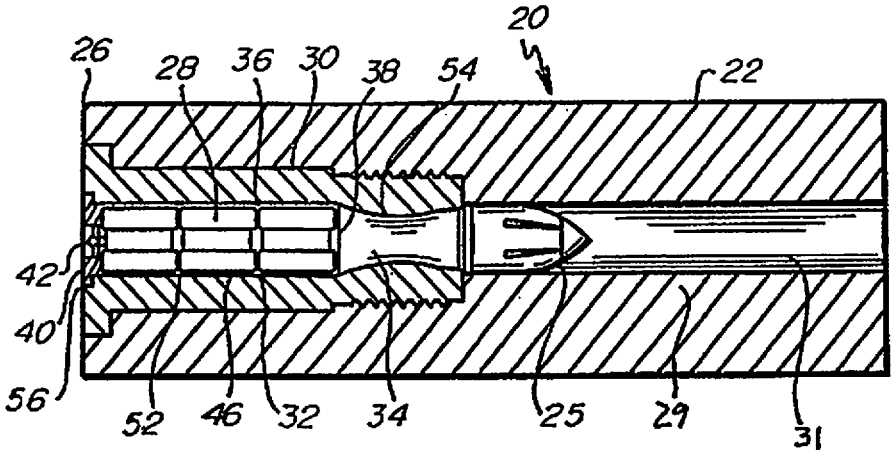
Fig.5
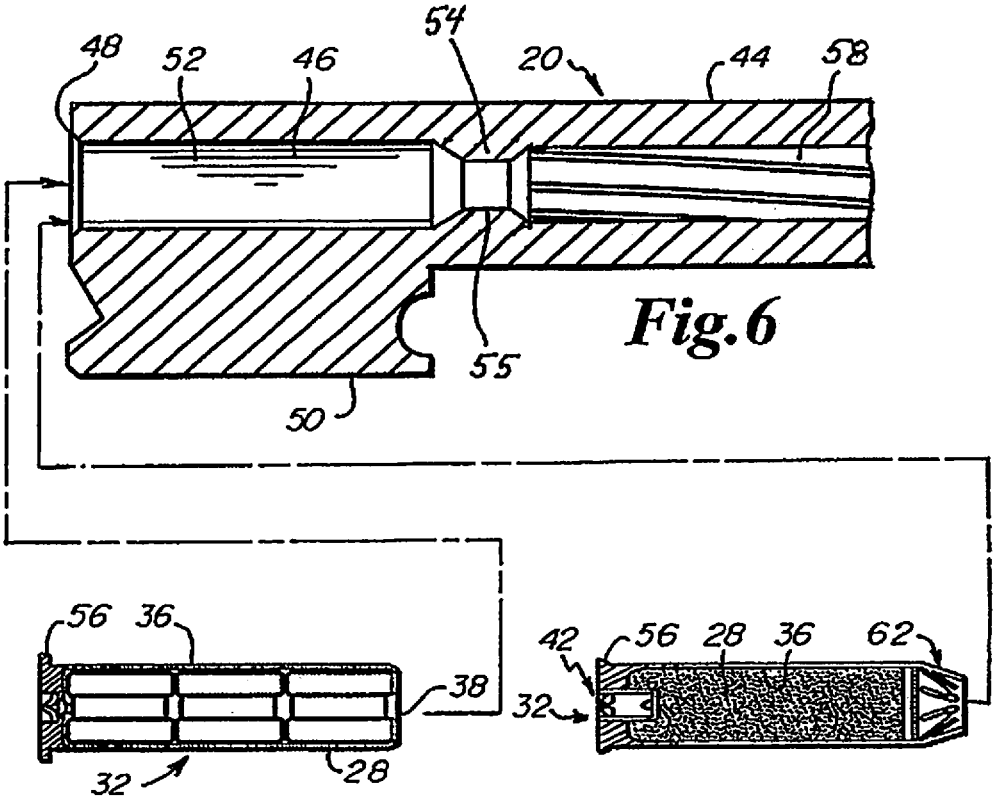
Fig.6
Fig.7
Fig.8

| |
|---|
| SELECT CARTRIGE CUP SIZE WITH TUBULAR WALL THICKNESS REFLECTING DESIRED PROPELLANT CAVITY VOLUME |
| SELECT PROPELLANT |
| FILL SELECTED CARTRIDGE |
| SELECT COMPACTION LEVEL |
| SELECT HEAD WITH APPROPRIATE DISPLACEMENT CORRESPONDING TO SELECTED COMPACTION LEVEL |
| INSERT HEAD INTO OPEN END OF FILLED CARTRIDGE |
| SECURE HEAD IN PLACE |

*Fig. 45*

MUZZLELOADER SYSTEMS

PRIORITY CLAIM

This application is a continuation application of application Ser. No. 14/869,619, filed Sep. 29, 2015, now U.S. Pat. No. 9,562,754, which claims priority to U.S. Pat. No. 9,146,086, which claims priority to U.S. Provisional Application No. 61/707,520, filed Sep. 28, 2012, U.S. Provisional Application No. 61/852,480, filed Mar. 15, 2013, and U.S. Provisional Application No. 61/802,264, filed Mar. 15, 2013, each of which is hereby fully incorporated herein by reference. U.S. Pat. No. 9,562,754 also claims priority to U.S. provisional application 62/096,660, filed Dec. 24, 2014, which is incorporated by reference herein. U.S. Pat. No. 9,562,754 also is a continuation-in-part application of U.S. patent application Ser. No. 14/041,951, filed Sep. 30, 2013, and which also claims priority to U.S. Provisional Application No. 61/707,520, filed Sep. 28, 2012, U.S. Provisional Application No. 61/852,480, filed Mar. 15, 2013, and U.S. Provisional Application No. 61/802,264, filed Mar. 15, 2013, each of which is hereby fully incorporated herein by reference. U.S. Pat. No. 9,562,754 also is a continuation-in-part of U.S. patent application Ser. No. 14/041,452, filed Sep. 30, 2013, which also claims priority to U.S. Provisional Application No. 61/707,520, filed Sep. 28, 2012, U.S. Provisional Application No. 61/852,480, filed Mar. 15, 2013, and U.S. Provisional Application No. 61/802,264, filed Mar. 15, 2013, each of which is hereby fully incorporated herein by reference.

FIELD OF THE INVENTION

The present invention is directed to a system for muzzleloaders for improving safety, reliability, and performance. A muzzle loader has a breech that allows a breech plug and/or a propellant and pre-packaged propellant cartridges to be loaded therein and has features preventing the breach loading of bullets.

BACKGROUND OF THE INVENTION

Muzzleloaders are a class of firearms in which the propellant charge and bullet are separately loaded into the barrel immediately prior to firing. Unlike modern breech loaded firearms where the bullet, propellant charge and primer are loaded as prepackaged cartridges, muzzleloaders are loaded by feeding a propellant charge through the muzzle of the barrel before ramming a bullet down the barrel with a ramrod until the bullet is seated against the propellant charge at the breech end of the barrel. A primer is inserted at the breech to be in communication with the propellant. The primer is then struck by an inline firing pin or an external hammer to ignite the propellant charge to create propellant gases for propelling the bullet.

The loading process of muzzleloaders creates issues unique to muzzleloaders. Specifically, the muzzleloader loading process requires that, unlike conventional breech loaded firearms, the bullet travel through the barrel twice, once during loading and once during firing. The tight fit of the bullet to the barrel can create substantial friction as the bullet travels through the barrel and is etched by the barrel rifling. During firing, the expanding propellant gases can overcome the frictional forces to propel the bullet through the barrel. However, during loading, the user must overcome the frictional force by applying an axial force to the bullet with the ramrod until the bullet is seated against the propellant charge. The friction between the bullet and the barrel can complicate the determination as to whether the bullet has been pushed far enough down the barrel during loading and is properly seated against the propellant charge. The relative position of the bullet to the propellant charge changes the pressurization of the barrel behind the bullet from the ignited propellant gases impacting the ballistic performance and potentially creating a substantial safety risk.

A concern with muzzleloaders is that the slower burning propellant required by muzzleloaders often foul the barrel with unconsumed residue requiring frequent cleaning of the barrel. The fouling can be severe enough that the barrel must be cleaned after every shot. The fouling can also interfere with the operation of the bullet and/or bullet with cup or sabot, causing damage to the cup and affect performance. In addition to contributing the fouling of the barrel, the deformation or damage to the sabot can impart wobble into the bullet or otherwise impact the ballistic performance of the bullet.

A variability in muzzleloaders not present in cartridge based firearms is the quantity and type of the propellant charge. Unlike cartridge firearms where a cartridge is preloaded with a bullet and premeasured quantity of propellant is loaded into the firearm for firing, the bullet and propellant charge are combined within the firearm for firing. Accordingly, the muzzleloader operator can select the optimal bullet, propellant type and quantity combination for each shot, which is particularly advantageous given the long reloading time for muzzleloaders. While the variability of the bullet—propellant charge combination allows for an optimized shot, varying the bullet and in particular the propellant and quantity of propellant can significantly change the appropriate seating depth of the bullet. With loose or powdered propellant such as black powder, the amount of propellant is often varied between 80 and 120 volumetric grains. Similarly, propellants are often formed into cylindrical pellets that are stacked end-to-end within the barrel to form the propellant charges. The pellets are typically each about 1 cm in length and loaded in 1 to 3 pellet groups causing an even greater variation in the seating depth. Variability in the powder and bullet of course causes variability in performance including accuracy.

A common approach to determining whether a bullet has been properly seated involves marking the ramrod with a visual indicator that aligns with the muzzle of the barrel when the end of the ramrod is at the appropriate depth with the barrel. The visual indicator is typically marked by loading the propellant charge and ramming a test bullet through the barrel. Once the user is certain that the bullet is properly seated against the propellant charge, the corresponding portion of the ramrod at the muzzle is marked. Although this approach is relatively easy to implement and widely used, the visual indicator approach detracts from the primary advantages of muzzleloaders. As the visual indicator approach is set based on a particular propellant charge and bullet combination, a variation in the propellant charge that changes the dimensions of the propellant charge can render the visual indicator at best useless or at worse a safety risk giving a false appearance of a properly seated bullet.

In addition to the hazards posed by an improperly loaded propellant, the process for unloading an unfired muzzleloader can also pose a significant safety challenge. Typically, a ramrod with a bullet extractor tip is inserted into the muzzle and engaged to the bullet to pull the bullet out of the barrel. The propellant charge is then pulled or poured from the now open barrel. The bullet extraction and propellant charge removal process is highly dangerous as the user's hands and head are near the muzzle of the barrel and could be struck if the muzzleloader accidentally discharged. Moreover, the muzzleloader is typically not aimed at a particular target during unloading and can cause further injury if not aimed in a safe direction. The inherent risks associated with the conventional method of unloading muzzleloaders are such that the conventional wisdom for safely unloading a muzzleloader is to fire the muzzleloader into the ground or in a safe direction rather than attempt a risky extraction of the bullet and removal of the propellant charge.

A similar consideration specific to hunting applications is that state and local laws typically require that the muzzleloader be unloaded while being transported in a motor vehicle from site to site. With certain types of game, hunters often check multiple sites in search of the targeted game. However, unloading the muzzleloader by firing the muzzleloader prior to leaving a site can spook the target game and other wildlife at that site and spoil the site for a period of time. Although certain laws are tailored to permit hunters to transport an otherwise loaded muzzleloader during hunting provided the primer is removed from the hole, the propellant charge and bullet are still seated within the barrel during transport posing a lessoned, but still substantial safety risk. As discussed above, the fouling can interfere with the safe operation of the muzzleloader as well as the ballistic performance of the bullet. While firing the muzzleloader can be comparatively safer method of unloading the bullet, the muzzleloader must often be cleaned after each firing. In a hunting situation where the muzzleloader may be fired several times to unload the muzzleloader for transport, the barrel may require cleaning, which can be difficult in the field.

One approach to addressing the reloading problem is replacing the closed breech end of the muzzleloader barrel with a screw-in, removable breech plug. The breech plug is removable from the breech end of the muzzle to remove the propellant charge from behind the bullet rather than attempting the remove the bullet from the muzzle end of the barrel. While the approach is effective in safely separating the propellant charge from the bullet, a common problem with removable breech plugs is seizing of the breech plug within the barrel. The rapid temperature changes during firing as well as the corrosive nature of many of the propellants can result in seizing of the corresponding threads of the breech plug and the barrel. If not carefully maintained, the breech plug will become difficult to remove to efficiently unload of the muzzleloader.

A related concern is that the performance of the hygroscopic propellant itself can be easily and often detrimentally impacted by the environmental conditions in which the propellant is stored. The sensitivity of the propellant can often result in "hang fires" where the ignition of the propellant charge is delayed or the propellant charge fails to ignite altogether. Hang fires are frequent occurrences and create a substantial risk for the user. The conventional approach to dealing with a hang fire is to point the muzzleloader in a safe direction until the muzzleloader fires or until sufficient time has passed to reasonably assume that the propellant charge failed to ignite altogether. The unloading process through the muzzle of the muzzleloader is particularly dangerous in hang fire situations as the propellant charge may ignite during the actual unloading process. Similarly, unloading through a breech plug can similarly be dangerous as the propellant charge may ignite as the breech plug is removed.

Another safety concern unique to muzzleloaders is an undersized or oversized propellant charge. Unlike cartridge firearms where the amount of propellant loaded for each shot is limited by the internal volume of the cartridge, theoretically, the amount of propellant loaded for each shot in muzzleloaders is only limited by the length of the barrel. While measures are often used to provide a constant quantity of propellant for each propellant charge, the measures can be difficult to use in the field or in low light situation when hunting often occurs. Similarly, propellant can be formed into the pre-sized pellets that can be loaded one at a time until the appropriate amount of propellant is loaded. As with measuring the quantity of powder, errors can occur in loading the appropriate number of pellets. Embodiments of the invention address the above issues.

SUMMARY OF THE INVENTION

A muzzle-loader bullet system includes a pre-packaged breech loaded propellant charge and primer for providing efficient loading and unloading of the muzzleloader. In embodiments, the muzzleloader has a breech portion, a projectile bore portion with a muzzle end, and a separator therebetween. The separator may be configured as a constrictor portion with a reduced diameter portion. The propellant containment vessel abuts against or is proximate the constriction portion with a reduced diameter portion. The propellant containment vessel may have an end portion with a tapered surface that conforms to the constriction portion surface. A projectile is inserted in the muzzle end and seats at the opposite side of the constriction portion from the propellant. A cup portion of the projectile may be injection molded, filled with propellant and then have a head portion that receives a primer fitted and adhered thereto. The ullage between the projectile and breech loaded propellant may be minimized with the configuration of the projectile and/or constriction portion. In other embodiments, propellant pellets or powder may be installed in the breech end. The projectile may have a cup portion that conforms to the ullage and is slidingly engaged with a bullet body. The projectile can be configured such that axially concentric sliding of the bullet body and cup portion shortening the axial length of the projectile radially and circumferentially expands the projectile, Ram rod means are provided for seating the projectile without axially compressing and shortening the projectile, whereby the projectile is readily loaded and upon firing is compressed and circumferentially expanded to provide enhanced sealing characteristics. In other embodiments, seating of the projectile may allow the axial reduction and radial expansion there by securing the bullet in position at its seat. This arrangement can facilitate loading powder in the breech end.

A feature and advantage of the muzzleloader and bullet system is providing enhanced performance and safety. The muzzle loading system comprises an energetic system with a pre-packaged propellant charge that is breech loaded, providing efficient loading and unloading of the muzzleloader and with means that preclude loading of the bullet in the breech.

A feature and advantage of embodiments of the invention is that the breech loading or unloading of the propellant charge allows for safe separation of the propellant charge from the bullet loaded within the barrel. When it is desired to unload the muzzleloader, the propellent containment vessel is removed, unfired, and the bullet can then be safely pulled or pushed down the barrel and removed from the muzzleloader without risk that the inadvertent or delayed ignition of the propellant charge will fire the projectile.

A feature and advantage of embodiments of the invention the breech portion comprises a nozzle or constriction portion between the propellant containment vessel and the projectile. The nozzle or constriction portion focuses and accelerates the propellant gases generated from the ignited propellant charge to improve the acceleration of the bullet within the barrel.

A feature and advantage of embodiments of the invention is that the containment vessel can comprise the integrated primer and be factory loaded or preloaded with a premeasured propellant charge. The primer and loaded containment vessel simplifies the loading process by combining the propellant measuring and loading steps with the primer positioning steps. The containment vessel can also serve to protect the propellant charge from environmental factors that could impact the ignition of the propellant charge.

A muzzleloader, according to a present invention, comprises a barrel, a breech plug, an external hammer. The breech plug is insertable into the breech end of the barrel and defines an axial chamber extending through the breech plug and aligning with the internal bore of the barrel. A containment vessel comprising an integrated primer and a cup with a propellant charge is insertable into the axial chamber of the breech plug to define the breech end of the barrel, wherein the integrated primer is positioned to be struck with the external hammer to fire the muzzleloader. Similarly, the containment vessel can be removed from the axial chamber to unload the muzzleloader.

A method of loading a muzzleloader, according an embodiment of the present invention, comprises providing a breech plug defining an axial chamber extending through the breech plug. The method further comprises inserting the breech plug into a breech end of a barrel, wherein the axial chamber aligns with the internal bore of the barrel when the breech plug is inserted into barrel. The method also comprises preloading a containment vessel having an integrated primer with a propellant charge. The method further comprises inserting the containment vessel with the loaded propellant charge into the axial chamber of the breech plug to load the muzzleloader. A feature and advantage of embodiments of the invention the method can also comprise removing the containment vessel from the axial chamber of the breech plug to unload the muzzleloader.

A method, according to an embodiment of the present invention, of modifying a muzzleloading firearm to receive a breech loaded propellant charge, comprises:

providing a muzzleloading firearm having a barrel having a bore running therethrough from a proximal end of the barrel to a distal end of the barrel, the bore including a proximal bore portion and a distal bore portion, with an axial channel defined in the proximal bore portion, sizing the axial channel in the proximal bore portion to define a chamber, wherein the chamber is sized to fittingly receive a containment vessel, the containment vessel being configured to receive a propellant charge, and modifying the barrel to provide a constriction portion at a position between the chamber and the distal bore portion, wherein the constriction portion prevents a muzzle loaded bore-diameter projectile from entering the chamber from the distal end of the bore.

A method, according to an embodiment of the present invention, of modifying a muzzleloading firearm to receive a removable breech plug, comprises:

providing a muzzleloading firearm having a barrel having a bore running therethrough from a proximal end of the barrel to a distal end of the barrel, the bore including a proximal bore portion and a distal bore portion, with an axial channel defined in the proximal bore portion, sizing the axial channel in the proximal bore portion to define a chamber, wherein the chamber is sized to fittingly receive a removable breech plug, and modifying the barrel to provide a constriction portion at a position between the chamber and the distal bore portion, wherein the constriction portion prevents a muzzle loaded bore-diameter projectile from entering the chamber from the distal end of the bore.

A method, according to an embodiment of the present invention, of modifying a firearm to receive an adapter breech plug, comprises the steps of:

providing a firearm having a barrel having a bore running therethrough from a proximal end of the barrel to a distal end of the barrel, the bore including a proximal bore portion and a distal bore portion, with an axial channel defined in the proximal bore portion, sizing the axial channel in the proximal bore portion to define a chamber, wherein the chamber is sized to fittingly receive an adapter breech plug, the adapter breech plug being configured to receive a propellant charge, and modifying the barrel to provide a constriction portion at a position between the chamber and the distal bore portion, wherein the constriction portion prevents a muzzle loaded bore-diameter projectile from entering the chamber from the distal end of the bore.

A method, according to an embodiment of the present invention, of modifying an adapter breech plug to be breech received by a muzzleloading firearm, comprises the steps of:

providing a muzzleloading firearm having a barrel having a bore running therethrough from a proximal end of the barrel to a distal end of the barrel, the bore including a proximal bore portion and a distal bore portion, with an axial channel defined in the proximal bore portion, the axial channel in the proximal bore portion defining a chamber, preparing an adapter breech plug having a diameter and outer surface, the adapter breech plug being configured to receive a propellant charge, sizing and shaping the diameter and outer surface of the adapter breech plug to conform to the chamber, wherein the adapter breech plug is sized to be fittingly received in the chamber, and modifying the barrel to provide a constriction portion at a position between the chamber and the distal bore portion, wherein the constriction portion prevents a muzzle loaded bore-diameter projectile from entering the chamber from the distal end of the bore.

In embodiments of the invention, moisture concerns normally associated with the very hygroscopic black powder (and black powder substitute) propellants are minimized due to the sealed vessel design. Embodiment provide enhanced ease of use in unloading all energetics from system at any time compared to most conventional muzzleloaders that require the removal of the breech plug in order to remove propellant, and precise loading compaction of the black powder propellant.

In an embodiment of the invention, propellant containment vessel comprises an integral cylindrical wall and conical tapering portion and a disk portion all unitary and formed of a polymer. Such may be advantageously injection molded and filled with propellant and then have a head portion secured thereto. The head portion having or receiving a primer. Advantageously, the head portion may be formed of brass or a polymer and may be adhered by adhesives or welding.

Embodiments herein are specifically addressed to muzzle-loading projectiles from 45 caliber to 50 caliber. Also the propellant packages may be sized from 20 gauge to 12 gauge and may be an intermediate, non standardized size.

A feature and advantage of embodiments of the invention is minimal ullage between the propellant charge and the projectile in a breech loaded propellant configuration that precludes breech loading of the projectiles Such is conducive to enhanced firing performance. The minimal ullage may be provided by an angled constriction portion that correlates to the propellant vessel.

A feature and advantage of embodiments of the invention is a projectile with a metal projectile body and a separate axially slidable component, the body and component having a common axis, and respective annular sliding engagement surfaces. The sliding from one defined position to another position having a hard stop defined by respective surfaces of the components.

In embodiments as described immediately above certain embodiments will affect a radial expansion at the another position. In embodiments the expansion is caused by cam surfaces, in embodiments, the expansion is caused by axial compression of a member causing is to bulge radially outward.

The above summary of the various representative embodiments of the invention is not intended to describe each illustrated embodiment or every implementation of the invention. Rather, the embodiments are chosen and described so that others skilled in the art can appreciate and understand the principles and practices of the invention. The Figures in the detailed description that follow more particularly exemplify these embodiments.

BRIEF DESCRIPTION OF THE DRAWINGS

The invention can be completely understood in consideration of the following detailed description of various embodiments of the invention in connection with the accompanying drawings, in which:

FIG. 5 is a cross-sectional side view of a breech end of a muzzleloader according to an embodiment of the present invention in the pre-fired condition.

FIG. 6 is a cross-sectional side view of a breech end of a muzzleloader according to an embodiment of the present invention.

FIG. 7 is a cross-sectional side view of a containment vessel according to an embodiment of the present invention.

FIG. 8 is a cross-sectional side view of a containment vessel according to an embodiment of the present invention.

FIG. 30 is a rear end view of a projectile according to embodiments of the invention.

FIG. 45 is a FLOW CHART of the methodologies illustrated in FIG. 46.

Figure 1:
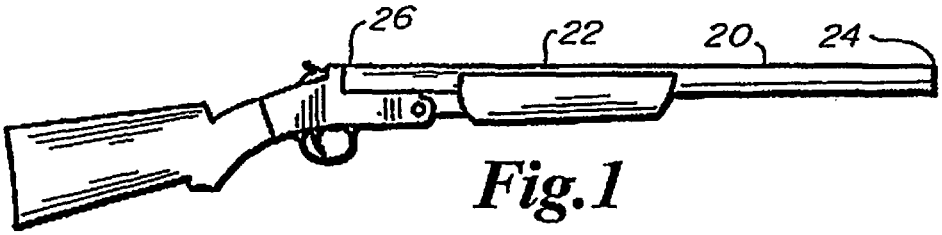
FIG. 1 is a cross-sectional side view of a muzzleloader barrel for use with the present invention.

While the invention is amenable to various modifications and alternative forms, specifics thereof have been depicted by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE INVENTION

Figure 2:
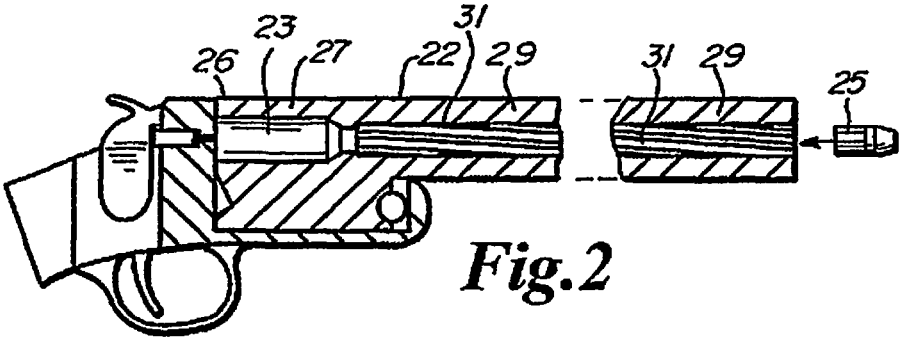
FIG. 2 is a cross-sectional side view of a muzzleloader barrel with a propellant charge positioned at a breech end of the barrel and a conventional bullet positioned at a muzzle end of the barrel.
Figure 3:
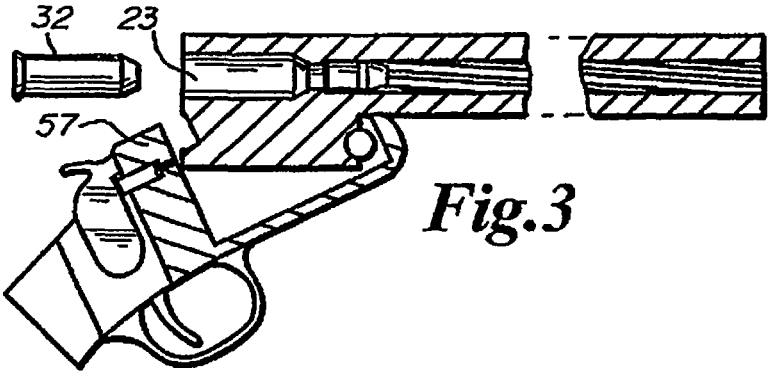
FIG. 3 is a cross-sectional side view of the muzzleloader barrel depicted in FIG. 2, with the conventional bullet pushed partially through the barrel with a ramrod.
Figure 4:
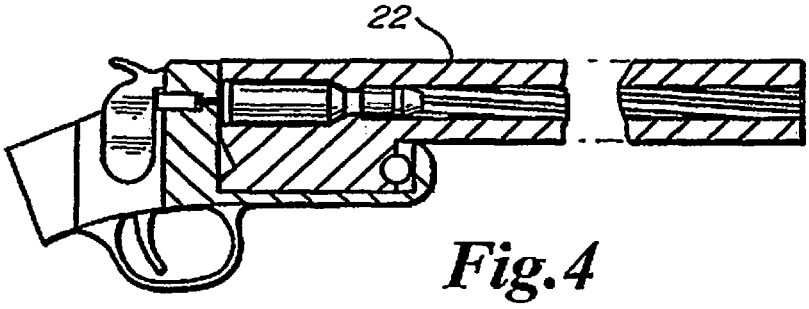
FIG. 4 is a cross-sectional side view of the muzzleloader barrel depicted in FIG. 2 with the conventional bullet seated against the propellant charge in the breech end of the barrel.

As depicted in FIGS. 1-4, a muzzleloader 20, for use with the present invention, generally comprises a barrel 22 having a breech 23 (or breech cavity), a breech end 26, and a muzzle end 24. The barrel 22 can comprise a smooth bore (not shown) or a rifled bore 31 as depicted in FIGS. 2-4. Referring to FIG. 2, the muzzleloader 20 is conventionally loaded with a projectile 25 at the muzzle end by pushing the projectile down the bore towards the breech end 26 until the projectile is seated. The breech is accessed for loading of the propellant as shown in FIG. 3 and a propellant containment vessel 32 or cartridge is inserted into the breech. The breech is closed as shown in FIG. 4 and is ready for firing.

As depicted in FIGS. 4 and 5, the muzzleloader 20, according to an embodiment of the present invention, can comprise the barrel 22 having an open breech end 26, a breech portion 27, and a projectile bore portion 29, and a projectile bore 31. In this configuration, the muzzleloader 20 can further comprise a breech plug 30 and a propellant containment vessel 32. The breech plug 30 defines an axial channel 34 extending through the breech plug 30. The axial channel 34 extends the effective length of the bore of the barrel 22 when the breech plug 30 is placed in the breech end 26 of the barrel 22. The containment vessel 32 further defines an axial cavity 36 having an open end 38 and a closed end 40. In some aspects of the invention, the open end 38 may be closed so as to wholly contain and seal the propellant charge for easier handling of the containment vessel 32 as more fully described below. FIG. 7 shows a containment vessel 32 having and open end 38. FIG. 8 shows an aspect of the invention, wherein the containment vessel 32 comprises containment mechanism 62. In the embodiment shown, the containment mechanism is crimping.

In operation, a propellant charge 28 can be loaded into the axial cavity 36 of the containment vessel 32. A feature and advantage of embodiments of the invention the open end 38 of the containment vessel 32 can comprises a containment mechanism, such as inward crimping 62 (shown in FIG. 8), can be crimped inwards after the propellant charge 28, as depicted in FIG. 5, to maintain the propellant charge 28 with the containment vessel 32 following loading of the propellant charge 28. The loaded containment vessel 32 can then be positioned within the axial channel 34 with the open end 38 oriented toward the projectile bore portion 29 of the barrel 22. Wherein the closed end 40 of the containment vessel 32 operates as effective breech end 26 of the barrel 22. A feature and advantage of embodiments of the invention the containment vessel 32 can comprise an integrated primer 42 in the closed end 40 of the containment vessel 32 that can be struck with an external hammer to ignite the propellant charge 28 and fire the muzzleloader 20. In this configuration, the primer 42 and propellant charge 28 can be loaded as a single energetic system for firing the muzzleloader 20. After firing or during unloading, the containment vessel 32 can be removed from the breech 23 and replaced with a new containment vessel 32 or remain unloaded. A feature and advantage of embodiments of the invention the containment vessel 32 further comprises a rim 56 for gripping the containment vessel 32 for removal of the containment vessel 32.

As depicted in FIG. 6, a muzzleloader 20, according to an embodiment of the present invention, can comprise a barrel 44 having an axial channel 46 or breech 23 through the breech end 48 of the barrel 44, wherein the axial channel 46 is adapted to receive a containment vessel 32. In this embodiment, the constriction portion 54 is unitary with the barrel defining a reduced diameter channel portion 55 that leads to a projectile bore portion 58. In this configuration, the barrel 44 can further comprise an engagement mechanism 50 for securing the barrel 44 to the mount assembly for a conventional firearm or muzzleloader such that the barrel 44 can be interchanged with a conventional muzzleloader barrel 22.

As depicted in the Figures, the breech plug 30 or the barrel 44 can be operated with a break action muzzleloader or a reconfigured break action rifle or a bolt action muzzleloader, not shown. In this configuration, the hammer receiver portion 57 secures the breech at the propellant containment vessel 32 to prevent the containment vessel 32 from moving rearward from the breech end 26, during firing.

As depicted in FIGS. 5-8, the axial channel 34 may comprise a vessel chamber 52 for receiving the containment vessel 32 and a nozzle or constriction portion 54. The constriction portion 54 is positioned between the propellant charge 28 and the bullet 25 when the containment vessel 32 is loaded into the vessel chamber 52. The constriction portion 54 accelerates the propellant gases generated from the ignition of the propellant charge 28 to improve the propulsion of the bullet from the barrel 44. In an aspect of the invention, the vessel chamber 52 which receives the containment vessel 32 is formed in the axial chamber 46 of the breech plug 30, as shown in FIG. 5 and, in another aspect, the vessel chamber 52 which receives the containment vessel 32 is formed in the axial chamber 46 of the breech end 48 of the barrel 44, as shown in FIG. 6.

As depicted in FIG. 5, a muzzleloader 20, according to an embodiment of the present invention, can further comprise a barrel 22 having an open breech end 26. In this configuration, the muzzleloader 20 can further comprise a breech plug 30 and a containment vessel 32. The breech plug 30 defines an axial channel 34 extending through the breech plug 30. The axial channel 34 extends the effective length of the bore of the barrel 22 when the breech plug 30 is placed in the breech end 26 of the barrel 22. The containment vessel 32 further defines an axial cavity 36 having an open end 38 and a closed end 40.

In operation, a propellant charge 28 can be loaded into the axial cavity 36 of the containment vessel 32. A feature and advantage of embodiments of the invention the open end 38 of the containment vessel 32 can be crimped inwards after the propellant charge 28, as depicted in FIG. 5, to maintain the propellant charge 28 with the containment vessel 32 following loading of the propellant charge 28. The loaded containment vessel 32 can then be positioned within the axial channel 34 with the open end 38 distally oriented toward the barrel 22, wherein the closed end 40 of the containment vessel 32 operates as the effective breech end 26 of the barrel 22. A feature and advantage of embodiments of the invention the containment vessel 32 can comprise an integrated primer 42 in the closed end 40 of the containment vessel 32 that can be struck with an external hammer to ignite the propellant charge 28 and fire the muzzleloader 20. In this configuration, the primer 42 and propellant charge 28 can be loaded as a single energetic system for firing the muzzleloader 20. After firing or during unloading, the containment vessel 32 can be removed axial channel 46 and replaced with a new containment vessel 32 or remain unloaded. A feature and advantage of embodiments of the invention the containment vessel 32 further comprises a rim 56 for gripping the containment vessel 32 for removal of the containment vessel 32.

As depicted in FIG. 6, a muzzleloader 20, according to an embodiment of the present invention, can comprise a barrel 44 having an axial channel 46 through the breech end 48 of the barrel 44, wherein the axial channel 46 is adapted to receive a containment vessel 32. In this configuration, the barrel 44 can further comprise an engagement mechanism 50 for securing the barrel 44 to the mount assembly for a conventional firearm or muzzleloader such that the barrel 44 can be interchanged with a conventional muzzleloader barrel 22.

As depicted in FIGS. 5-8, the breech plug 30 or the barrel 44 can be operated with a break action muzzleloader or a reconfigured break action rifle. In this configuration, the hammer block engages at least the rim 56 of the containment vessel 32 to prevent the containment vessel 32 from moving rearward from the breech end 26, 48 of the barrel 22, 44 during firing as a result of the back blast from ignited propellant charge 28.

As depicted in both FIGS. 5-8, the axial channel 34 can further comprise a vessel chamber 52 for receiving the vessel 32 and a constriction portion 54. The constriction portion 54 is positioned between the propellant charge 28 and the bullet when the containment vessel 52 is loaded into the vessel chamber 52. The constriction portion 54 may accelerate the propellant gases generated from the ignition of the propellant charge 28 to improve the propulsion of the bullet from the barrel 22, 44.

Figure 9:
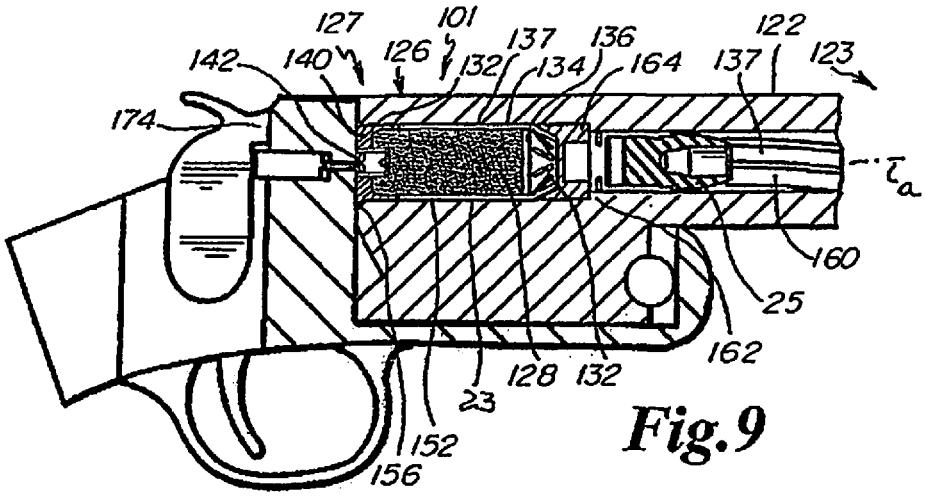
FIG. 9 is a cross-sectional side view of a breech end of a muzzleloader according to an embodiment of the present invention in the pre-fired condition.

As depicted in FIG. 9, a containment vessel receiving muzzleloader 120, according to an embodiment of the present invention, is configured to receive a containment vessel 132 within the breech region 101 of the muzzleloader instead of a breech plug. The containment vessel is a propellant cartridge, as illustrated with a unitary casing and crimped end. The muzzleloader 120 can further comprise a barrel 122 having a distal end 123 and having an open breech end 126 at a proximal end 127. In this configuration, the muzzleloader 120 can further comprise an axial channel 134 or breech 23 in the proximal end 127 of the barrel 122. The breech 23 defines a vessel chamber 152 and as illustrated a containment vessel 132 is contained within the vessel chamber 152. The containment vessel 132 further defines an axial cavity 136 having a distal closed end 162 and a proximal closed end 140 configured to receive the propellant charge 128. The breech chamber 159 and vessel chamber 152 defined therein are separated from a distal bore portion 160 by a narrowing internal shoulder 162 at the distal end of axial channel 134 and at the proximal end of the distal bore portion 160.

In operation, a propellant charge 128, 28 can be loaded into the axial cavity 136, 438 of the containment vessel 132, 432. A feature and advantage of embodiments of the invention the containment vessel has an open end 438 and, in another aspect, has a closed end 462 to contain the propellant charge 128, 28 within the containment vessel 132, 432 following loading of the propellant charge 128, 28, as depicted in FIGS. 7-8. The loaded containment vessel 132 can then be positioned within the axial channel 134 with the end 162 (in the case shown in FIG. 9, closed end 162, 462) oriented distally toward the barrel 22, wherein the closed end 162 of the containment vessel 132 operates as effective breech end of the barrel 122. A feature and advantage of embodiments of the invention the containment vessel 132 can comprise an integrated primer 142 in the closed end 140 of the containment vessel 132 that can be struck with an external hammer 174 to ignite the propellant charge 128 and fire the muzzleloader 120. In this configuration, the primer 142 and propellant charge 128 can be loaded as a single energetic system for firing the muzzleloader 120. After firing or during unloading, the containment vessel 132 can be removed via the axial channel 134 and replaced with a new containment vessel 132 or remain unloaded. A feature and advantage of embodiments of the invention the containment vessel 132 further comprises a rim 156 for gripping the containment vessel 132 for removal of the containment vessel 132.

A method of manufacturing or retrofitting a containment vessel receiving muzzleloader 120 which utilizes a containment vessel 132 comprises providing a muzzleloader having a barrel 122 which has a bore running therethrough from a proximal end of the bore to a distal end of the bore. The bore includes a proximal bore portion 159 and a distal bore portion 137, with an axial channel 134 defined in the proximal bore portion 159, and a narrowing internal shoulder 162 within the bore separating the proximal bore portion from the distal bore portion. The method also comprises sizing the axial channel 134 to define a vessel chamber 152, wherein the vessel chamber is sized to fittingly receive a containment vessel 132. The method further comprises inserting or integrally forming within the bore a forcing cone 164 at a position within the bore proximally adjacent the narrowing shoulder 162.

Figure 10:
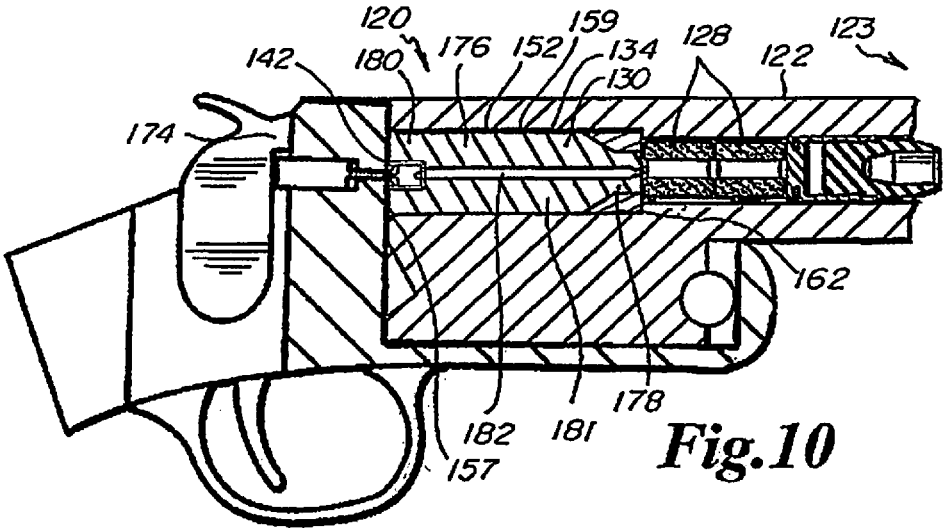
FIG. 10 is a cross-sectional side view of a breech end of a muzzleloader according to an embodiment of the present invention in the pre-fired condition.
Figure 11:
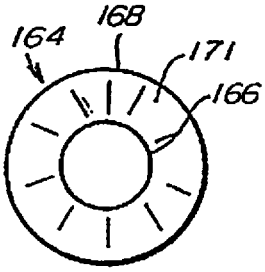
FIG. 11 is an end view of a constriction portion according to an embodiment of the invention.
Figure 12:
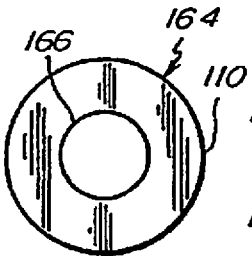
FIG. 12 is an end view of a constriction portion according to an embodiment of the invention.
Figure 13:
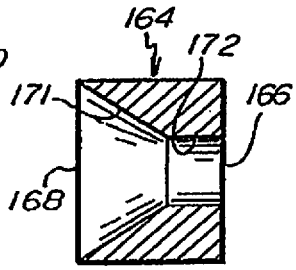
FIG. 13 is an end view of a constriction portion according to an embodiment of the invention.

As depicted in FIG. 10, the containment vessel receiving muzzleloader 120 shown in FIG. 9, according to an embodiment of the present invention, can comprise a removable breech plug 176 instead of a containment vessel 132. The removable breech plug is sized to be fittingly received within the vessel chamber 152 and allow the muzzleloader to be loaded in a conventional manner. The removable breech plug 176 has a distal end 178 and a proximal end 180, wherein, when fitted into the vessel chamber 152, the distal end 178 abuts against the forcing cone 164. The removable breech plug 176 can include an integrated primer 142 in its proximal end 180, a flash passage 182 extending from the primer 142 to and opening up at the distal end 178, and an otherwise solid body 181. In an aspect of the invention the removable breech plug does not have any outer threads and is installed with a slidable fit. The primer 142 can be struck with an external hammer 174 to ignite the propellant charge 128, which is loaded through the distal end 123 of the barrel 122 with the bullet and fire the muzzleloader 120. In this embodiment, the propellant charge 128 is loaded with the bullet and is positioned distal to the internal shoulder 162 and the forcing cone 164. After firing or during unloading, the removable breech plug 176 can remain and be used with a further load or can be removed via the axial channel 134 and replaced with a containment vessel 132 or remain unloaded. A feature and advantage of embodiments of the invention the removable breech plug 176 further comprises a rim 157 for gripping the removable breech plug 176 and insertion of a containment vessel 132.

Figure 14:
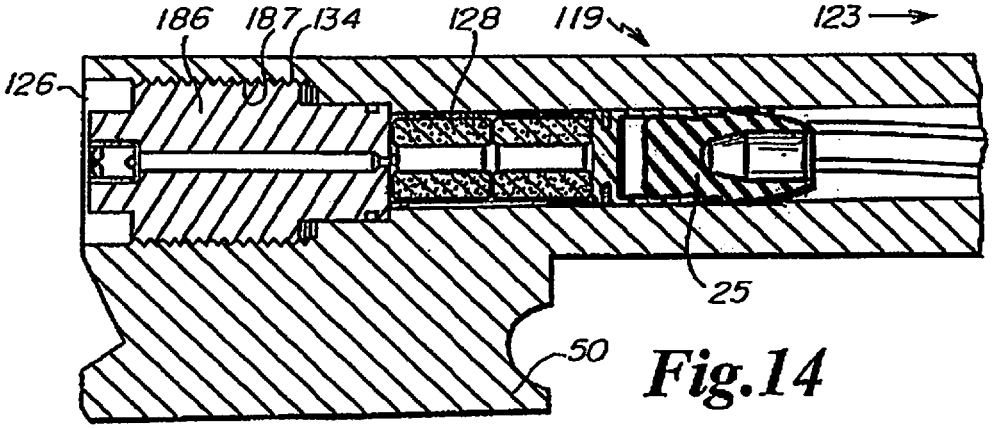
FIG. 14 is a cross-sectional side view of a breech end of a muzzleloader in the pre-fired condition.
Figure 15:
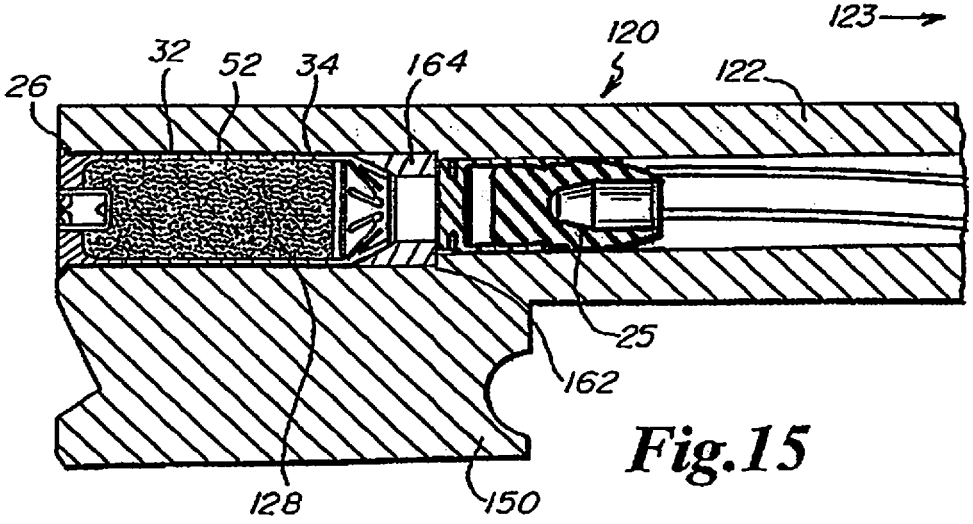
FIG. 15 is a cross-sectional side view of a breech end of a muzzleloader according to an embodiment of the present invention in the pre-fired condition.

FIGS. 14 and 15 illustrate the breech region of a representative muzzleloader barrel 119 having a conventional breech plug 186 (FIG. 14 illustrates a '209 primer adapter') with a securing plug 129, and a muzzleloader 120, according to an embodiment of the present invention, having a containment vessel 132 (FIG. 15). The Figures illustrate differences between the two, including the construction or retrofit of the axial channel 134 in muzzleloader 120 and the inclusion of a conventional, threaded-in 187 breech plug 186 in the commercial muzzleloader 119, as opposed to the slidably received containment vessel 132 of inventive muzzleloader 120. A further difference is the inclusion of the separator configured as a forcing cone 164 in the present invention, as shown in FIG. 15. In the convention muzzleloader 119, the propellant 128 and bullet are loaded at the distal barrel end, resulting in the propellant sitting directly on the breech plug 186 and the bullet seated right on the propellant. After firing, the propellant residue remains in the barrel in the position where the next propellant and bullet are to be placed. Cleaning may need to be accomplished by removing the plug 186. In contrast, in the inventive muzzleloader 120, the propellant 128 in the containment vessel 132 is in the vessel chamber 152 within the axial channel 134, which is spaced and separated from the bullet by the internal shoulder 162 and the forcing cone 164. Further, after firing the propellant casing is easily removable out the proximal end of the barrel, minimizing cleaning and allowing for quicker reload. The present invention provides ease of use, minimizes moisture concerns with the very hygroscopic black powder (and black powder substitute) propellants with the sealed vessel designs.

In a method, commercial barrels, such as the one shown in FIG. 14, can be altered and retrofitted to receive a containment vessel 132 or removable plug 176 according to the invention by resizing the axial channel of the breech end of the barrel so as to receive a containment vessel 132 or removable plug 176 and include an internal shoulder 162, and fitting the distal end of the resized axial channel 134 with a forcing cone 164 and abutting said forcing cone 164 proximally against the internal shoulder within the axial channel 134. A further aspect of the present inventive method is inserting an adapter breech plug that is fittingly receivable into the axial channel of the commercial barrel, wherein the adapter breech plug includes an axial channel sized to receive a containment vessel 132 and wherein a forcing cone 164 is positioned within the distal end of the axial channel 134 of the commercial barrel 119 or within the distal end of the axial channel of the adapter breech plug. An embodiment of an adapter breech plug is illustrated in FIG. 18.

As further depicted in FIG. 15, the muzzleloader 120, according to an embodiment of the present invention, comprises a barrel 122 having an axial channel 134 through the breech end 126 of the barrel 122, wherein the axial channel 134 is adapted to receive a containment vessel 132. In this configuration, the barrel 122 can further comprise an engagement mechanism 150 for securing the barrel 122 to the mount assembly 151 (seen in FIG. 17) for a conventional firearm or muzzleloader such that the barrel 444 can be interchanged with another muzzleloader barrel.

Figure 16:
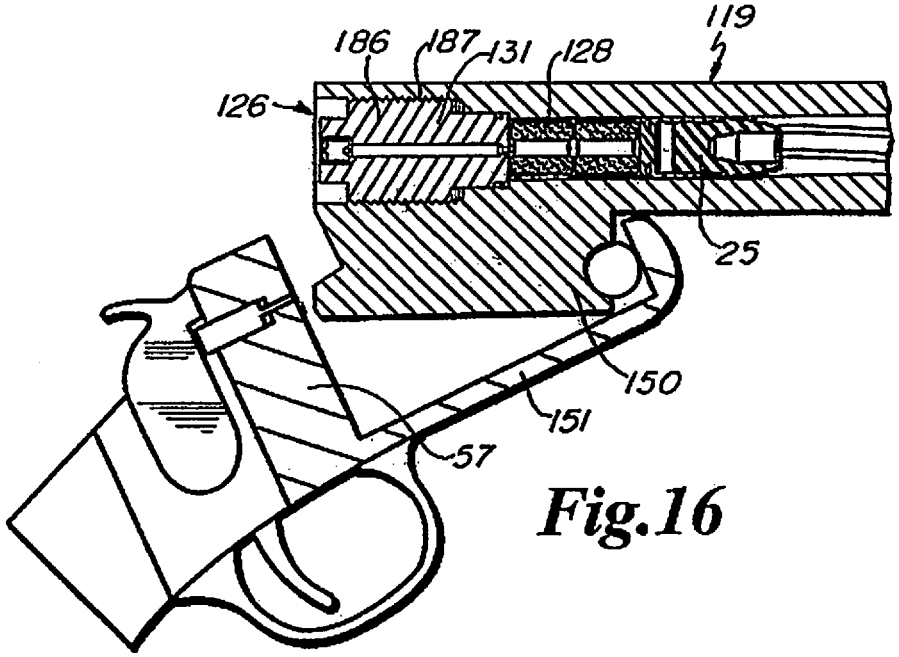
FIG. 16 is a cross-sectional side view of a breech end of a muzzleloader in the pre-fired condition.
Figure 17:
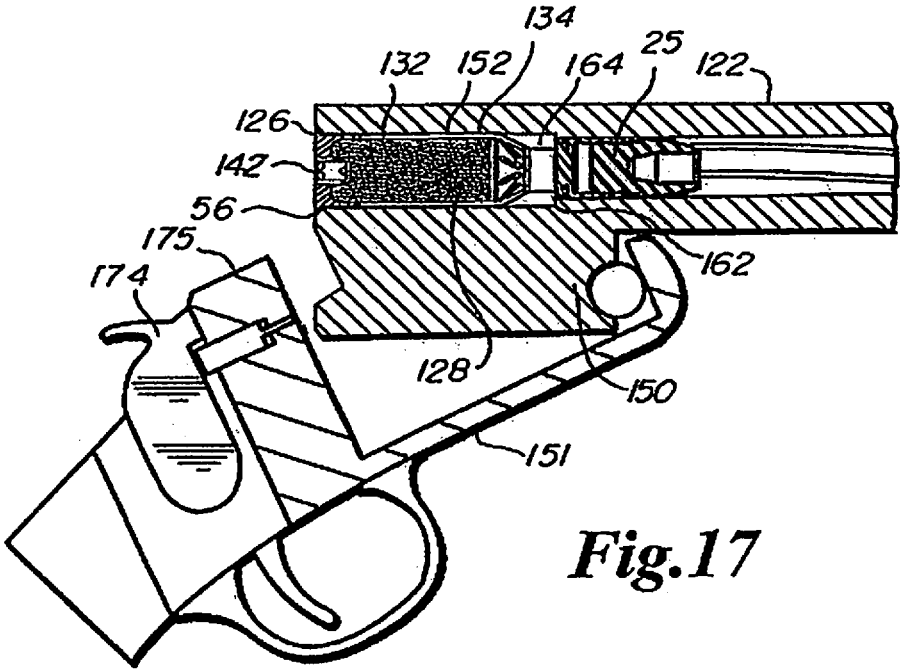
FIG. 17 is a cross-sectional side view of a breech end of a muzzleloader according to an embodiment of the present invention in the pre-fired condition.

FIGS. 16 and 17 illustrate the barrels of FIGS. 14 and 15, respectively, with the barrels engaged and secured to mount assemblies 151 via the engagement mechanisms 150 and the break actions open.

Figure 18:
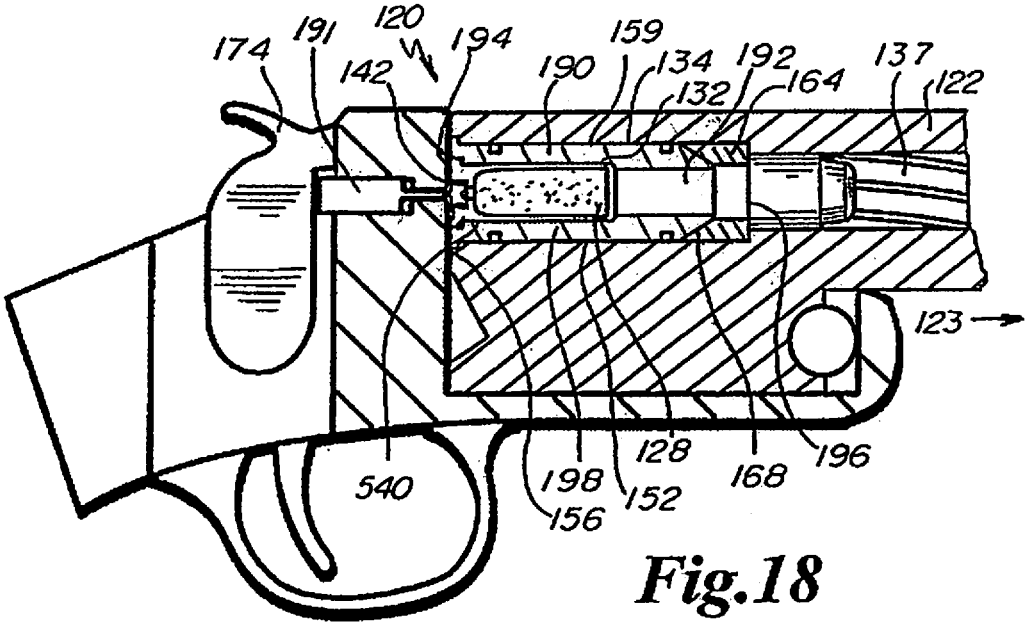
FIG. 18 is a cross-sectional side view of a breech end of a muzzleloader in the pre-fired condition.

As depicted in FIG. 17, barrel 122 shown in FIG. 15 can be operated with a break action muzzleloader or a reconfigured break action rifle utilizing either a containment vessel 134, a removable plug 176 or an containment vessel containing adapter plug (as shown in FIG. 18). In this configuration, the hammer block 175 engages at least the rim 156 of the containment vessel 132 to prevent the containment vessel 132 from moving rearward from the breech end 126 of the barrel 122 during firing as a result of the back blast from ignited propellant charge 128.

As depicted in FIG. 18, in a further embodiment of the invention, the containment vessel 132 within the vessel chamber 152 can be replaced with an adapter breech plug 190. As shown in FIG. 18, the adapter breech plug 190 is sized to be received within the vessel chamber 152 like the containment vessel 132. The adapter breech plug 190 further defines an axial cavity 192 having a proximal closed end 194 and a distal open end 196 configured to receive a propellant charge 128 of a smaller size. The distal end 196 of the adapter breech plug 190 can be formed to be fittingly received into the conical portion of the forcing cone through the top end 168. The axial cavity 192 extends the effective length 135 of the bore 137 of the barrel 122 at a proximal bore portion 159 to the forcing cone 164. The wall 198 of the adapter breech plug 190 can be varied to alter the diameter of the axial cavity 192 allowing for the snug fit of propellant charges of different sizes. A feature and advantage of embodiments of the invention the adapter breech plug 190 can comprise an integrated primer 142 in the closed end 140 of the adapter breech plug 190 that can be struck with an inline firing pin 191 to ignite the propellant charge 128 and fire the muzzleloader 120. In this configuration, in use, the primer 142 and propellant charge 128 can be loaded as a single energetic system for firing the muzzleloader 120. After firing or during unloading, the adapter breech plug 190 can be removed via the axial channel 134 and the propellant charge can be replaced with a propellant charge or remain unloaded. A feature and advantage of embodiments of the invention the adapter breech plug 190 further comprises a rim 156 for gripping the adapter breech plug 190 for removal of the adapter breech plug 190.

Figure 19:
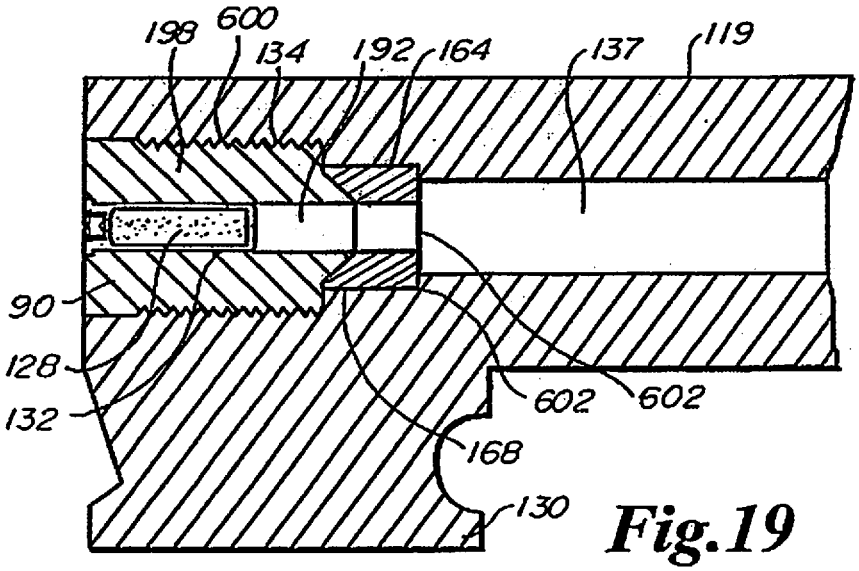
FIG. 19 is a cross-sectional side view of a breech end of a muzzleloader according to an embodiment of the present invention wherein the breech plug secures a constriction portion and a propellant cartridge is in place in a bore sized to the constriction portion.
Figure 20:
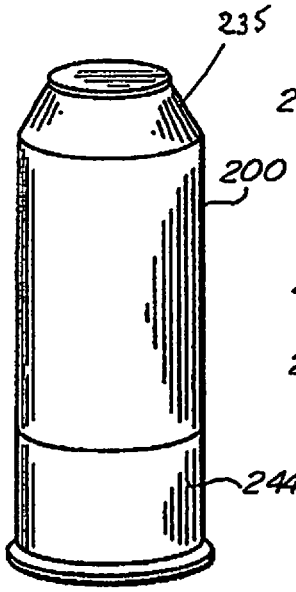
FIG. 20 is a perspective view of a propellant package configured as a cartridge with a primer.
Figure 21:
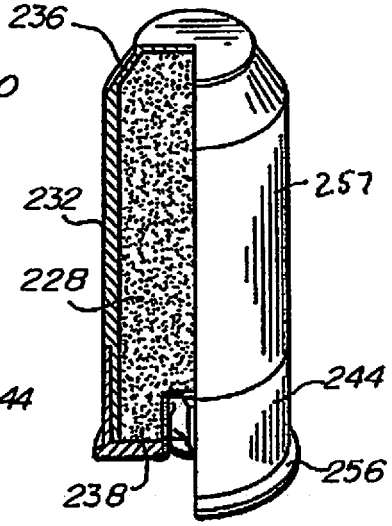
FIG. 21 is a perspective view with a partial cut-away cross section of the propellant cartridge of FIG. 20.
Figure 22:
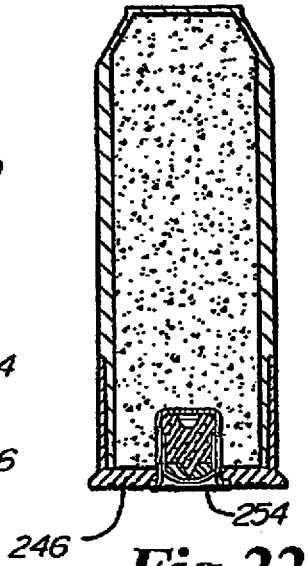
FIG. 22 is a cross section of the propellant cartridge of FIG. 20.
Figure 23:
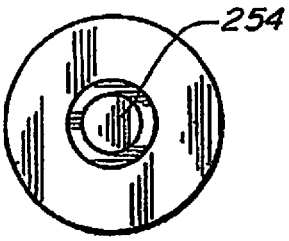
FIG. 23 is an end view of the propellant cartridge of FIG. 20.

A further aspect of the invention and method of the present inventive is that the adapter breech plug 190 and forcing cone 164 can be sized with regard to their outer diameters, lengths and outer surfaces to accommodate axial channels of other commercially available muzzleloaders. By way example, as shown in FIG. 16 (which shows the commercial barrel 119 of FIG. 19); the adapter breech plug 190 can be adjusted in a size and configuration to conform to the axial channel 134 of the barrel 119. In this case, the adapter breech plug is adapted by increase its diameter, which in this case results in a thicker wall 198, and conform the outer surface 600 to the inner surface of the axial channel 134 of the barrel 119. In this case, the outer surface 600 is threaded. For the conversion of the energetic system to conform to barrel 119, the forcing ring 164 can also be altered to conform to the distal end 602 of the axial channel 134 of the barrel 119. The distal end 196 of the adapter breech plug 190 can be similarly adjusted to form fit into the conical portion of the forcing cone through the top end 168. The axial cavity 192 can also be increased in diameter to receive a larger containment vessel 132.

In a method, providing a muzzleloader having an axial channel in its barrel at its proximal breech end and providing an adapter breech plug having or constructing it to have an outer surface that is fittingly receivable into the axial channel of the barrel, wherein the adapter breech plug includes an axial channel sized to receive a containment vessel and wherein a forcing cone is positioned within the distal end of the axial channel of the barrel or within the distal end of the axial channel of the adapter breech plug.

Figure 24:
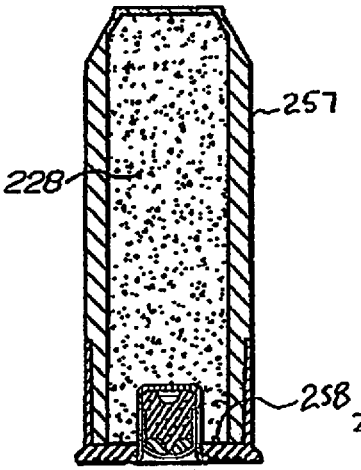
FIG. 24 is a cross section of the propellant cartridge of FIG. 20.
Figure 25:
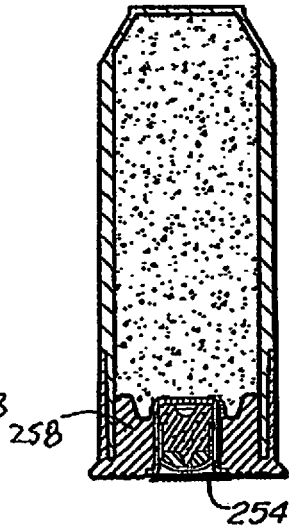
FIG. 25 is a cross section of the propellant cartridge of FIG. 20.
Figure 26:
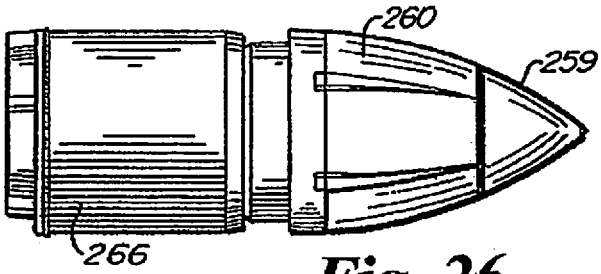
FIG. 26 is a side elevational view of a projectile according to embodiments of the invention.
Figure 27:
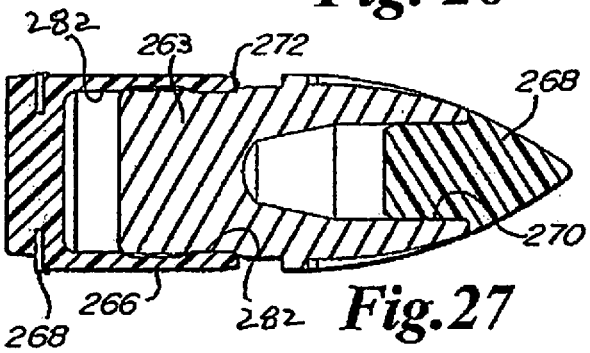
FIG. 27 is a cross sectional view of a projectile according to embodiments of the invention.
Figure 29:
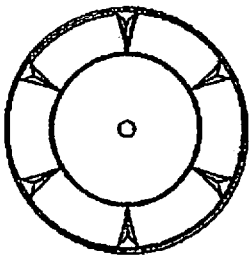
FIG. 29 is a front perspective view of the projectile of FIG. 28A.
Figure 28A:
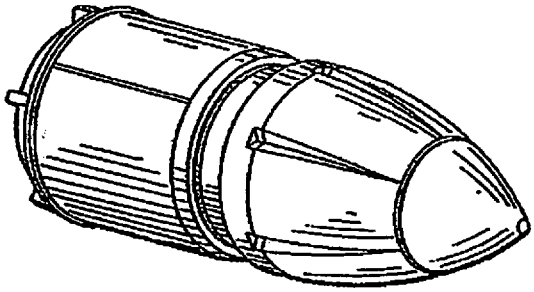
FIG. 28A is a front perspective view of a projectile according to embodiments of the invention in an axial elongated state.
Figure 28B:
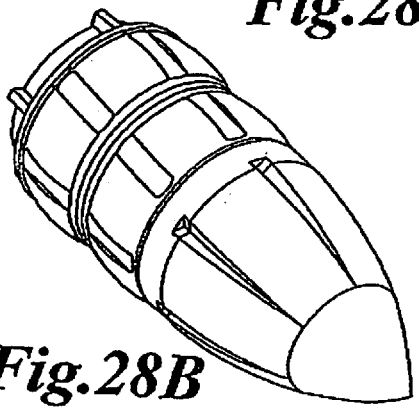
FIG. 28B is a front perspective view of the projectile of FIG. 28A in an axial shortened state and illustrating grooves engraved on the cup by rifling.
Figure 28C:
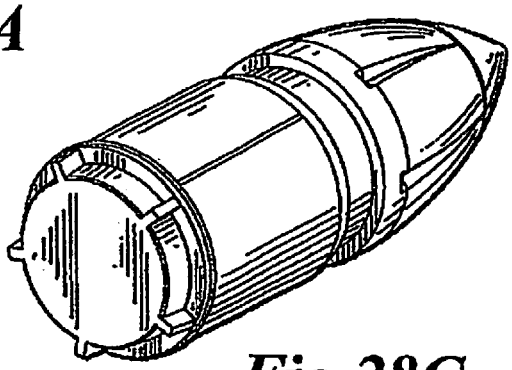
FIG. 28C is a rear perspective view of the projectile of FIG. 28A in an axial shortened state.
Figure 31:
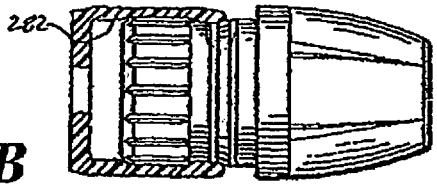
FIG. 31 is a side elevational view of a projectile body with a cup engaged thereon in an axially elongated position, the cup having an aperture therein.

Referring to FIGS. 20-25 several views of propellant cartridges 200 comprising containment vessels 232 and propellant 228 are illustrated. The cartridges each have a cup portion 257 comprising a tubular wall portion 232, a converging portion at a closed end 236, and an open end 238. A head portion 244 connects to the open end 238 of the cup portion tubular portion 242. A disk shaped portion 246 is unitary with the tubular portion 242 and has a recess 250 for receiving a primer 254 and a flange portion 256. The tubular portion and closed end are unitarily formed as the cup portion 257. Such may be injection molded from polymers such as polyethylenes or fabricated from metals. The head portion may also be injection molded or formed from convention materials such as brass. The head portion and cup portion may be press fit together and joined by way of crimping, welding, adhesives, or other securement means. As illustrated in FIGS. 24 and 25, the wall portion and head portion may have different configurations. Specifically, different wall thicknesses for the cup portion allows for different quantities of propellant and can provide structural enhancements. Also, the head portions may have different volumetric displacement portions 258 which, when attaching to a propellant filled cup portion, allows different levels of compaction. Although not shown, the tubular portions can have, in cross section, regular polygon shapes as well as the circular shape shown.

Figure 30:
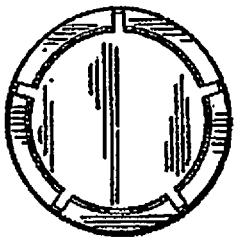
FIG. 30 is a rear perspective view of the projectile of FIG. 28A
Figure 30A:
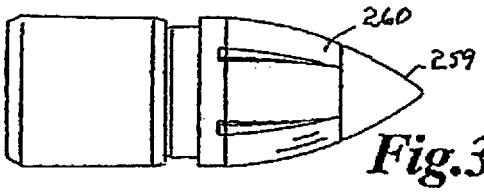
FIG. 30A is a front elevational view of a projectile according to embodiments of the invention in an axially elongated state.
Figure 30B:
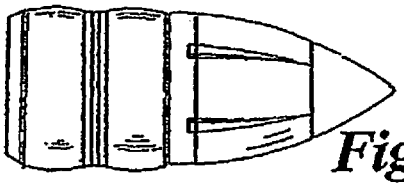
FIG. 30B is a front elevational view of a projectile according to embodiments of the invention in an axially shortened state.
Figure 30C:
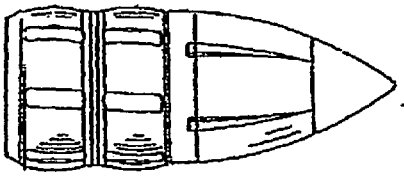
FIG. 30C is a front elevational view of a projectile according to embodiments of the invention in an axially shortened state with grooves engraved thereon from rifling in a barrel.
Figure 30D:
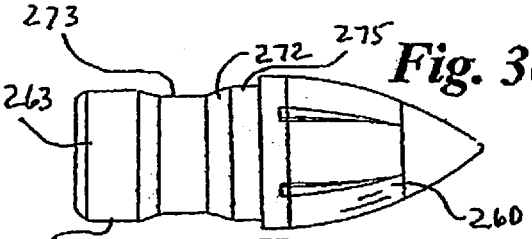
FIG. 30D is a side elevational view of a projectile body according to embodiments of the invention utilizing raised and recessed surfaces for radially expanding the cup.
Figure 30E:
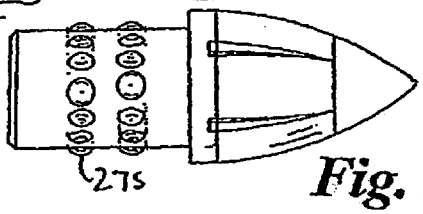
FIG. 30E is a side elevational view of a projectile body according to embodiments of the invention utilizing nodules as the radial expansion means for the cup.
Figure 30G:
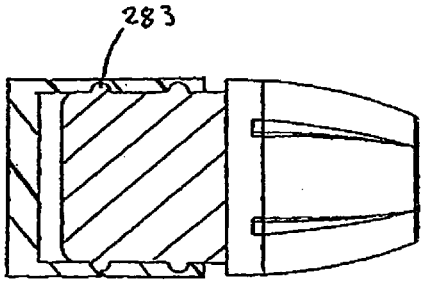
FIG. 30G is a side elevational view with the tail portion and cup in cross section should the projectile body of FIG. 30F with a cup in place in an axially elongated position.
Figure 30F:
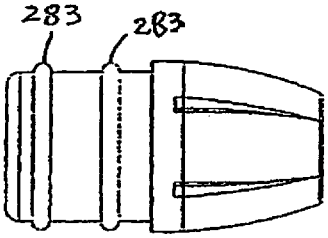
FIG. 30F is a side elevational view of a projectile body according to embodiments of the invention utilizing ribs extending around the tail portion.
Figure 30H:
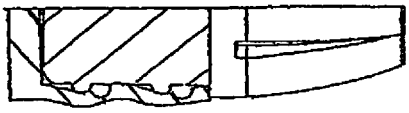
FIG. 30H is a partial side elevational view of the projectile body and cup of FIG. 30G in the axially shortened configuration.
Figure 32:
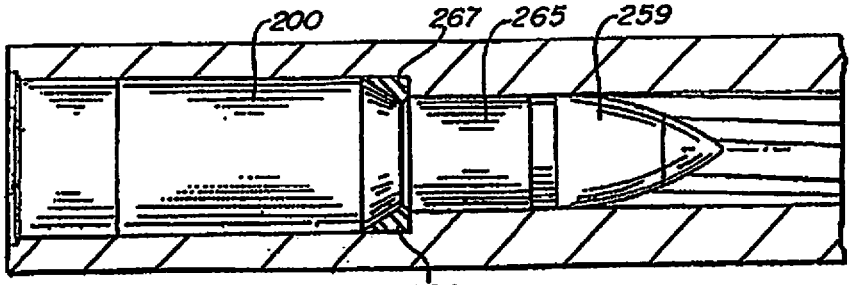
FIG. 32 is a cross sectional view of a breech end of a muzzleloader barrel with a propellant package and a projectile abutting up to a constriction portion.
Figure 33:
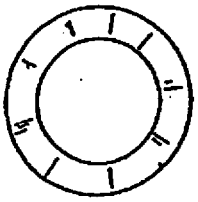
FIG. 33 is an elevational view of the constrictor of FIG. 32.
Figure 34A:
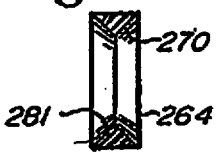
FIG. 34A is a cross sectional view of a constrictor similar to that of FIG. 33.
Figure 34B:
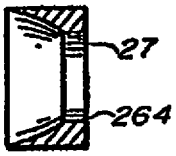
FIG. 34B is an alternative constriction portion that conforms to the propellant cartridge of FIG. 35A.

Referring to FIGS. 26-31, projectiles 259, including projectile bodies 261 and cups 266. according to the inventions herein are illustrated. These particular embodiments have a head portion 260, a tail portion 263, a slidable component 266 configured as the cup. The cup may further have a cutting ring 268. A polymer nose insert 268 fits into a recess 270 in the head portion in particular embodiments. Referring to FIGS. 27, 30D, 30E-30H, and 31, the tail portion and tubular portion of the cup have cooperating surfaces to affect a radial expansion as the cup moves axially on the tail. The surfaces can be a tapered portion 272 upon which the lip 274 of the cup rides increasing the radial expansion of the projectile. The projectile body can have circumferential recesses 273 and circumferential projections 275. As illustrated in FIG. 30E the circumferential projections do not need to be continuous circumferentially, the can be, for example circumferentially spaced bumps 278 or nodules. Also, the cup can have thickened portions 282 that extend radially inward. In an embodiment, the projectile body is metal, such as lead, copper, steel, or other alloys or other metals. The tail can have circumferential ribs 283 and a cup 285 with recesses corresponding to the ribs as illustrated in FIGS. 30F and 30G. When compressed, as illustrated in FIG. 30H, the ribs force portions of the cup axially offset from the recesses to bulge outwardly affecting the radial expansion. The cup may be polymers or metals in some embodiments.

Referring to FIGS. 32-34C, a minimal ullage configuration is illustrated with the propellant package or cartridge 200 abutting a constriction portion 264 and the projectile 259 also abutting up against the constriction portion. In this embodiment the projectile tail portion 265 can have a conical surface 267 to conform to the muzzle facing surface 270 of the constriction portion 264. This surface is conical in FIGS. 32 and 34 and may have other shapes that converge or have a face perpendicular to the axis. This facilitates the minimal ullage between the projectile 259 and the propellant which is believed to provide enhanced propellant and projectile performance.

Figure 35A:
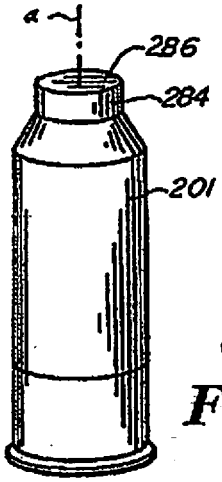
FIG. 35A is an alternative view of a muzzleloader propellant cartridge.
Figure 35B:
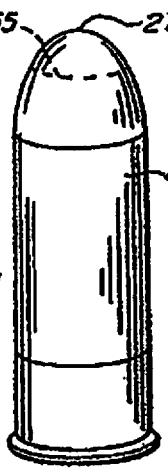
FIG. 35B is an alternative view of a muzzleloader propellant cartridge.
Figure 35C:
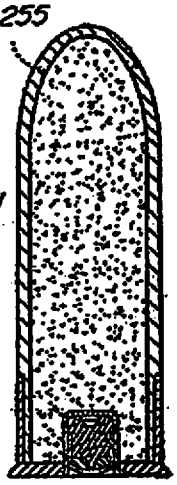
FIG. 35C is a cross sectional view of the cartridge of FIG. 35B.
Figure 34C:
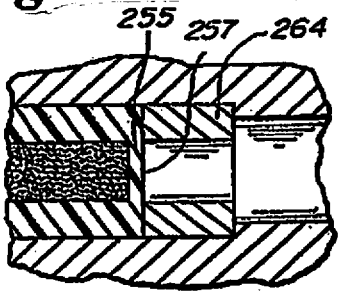
FIG. 34C is another constriction portion in place in a barrel.
Figure 36:
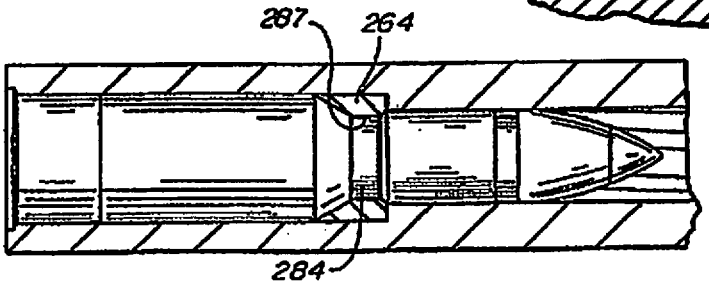
FIG. 36 is a cross sectional view of a breech end of a muzzle loader with the propellant cartridge of FIG. 35A therein and with minimal or no ullage between the projectile and the propellant cartridge.

Referring to FIGS. 34A, and 35A-36, other means of minimizing ullage is illustrated. In FIG. 35, the propellant cartridge 201 has the conical portion 279 that corresponds to and engages the conical portion 281 of the constriction portion 264 that faces the breech opening. The cartridge also has a neck portion 284 that has a cylindrical shape and a disk 286 perpendicular to the axis a of the cartridge. As illustrated in FIG. 36 the neck portion can extend into and conform to the reduced diameter portion 287 of the constriction portion 264, also presenting minimal ullage. FIGS. 35B and 35C illustrate another configuration of a propellant cartridge according to embodiments of the invention with the cartridge having a rounded tip. The constriction portion 264 can have the surface that faces the breech end have a curvature that corresponds to the rounded tip. In embodiments the tip can extend beyond the converging portion, to confront or engage the projectile. In FIG. 34C, the constriction portion 264 can be rectilinear such as a conventional washer with two planar faces, and cylindrical outer surface and a cylindrical inner surface. In such an embodiment, the cup of the cartridge may have outer walls such that the inner surface of the outer wall is in alignment with the inner surface of the constriction portion or separator portion. A polymer cartridge casing can have weakening structure 255, such as scoring or grooves, in alignment with the inner cylindrical surface of the constriction portion to facilitate uniform separation of the disk 257.

Figure 37:
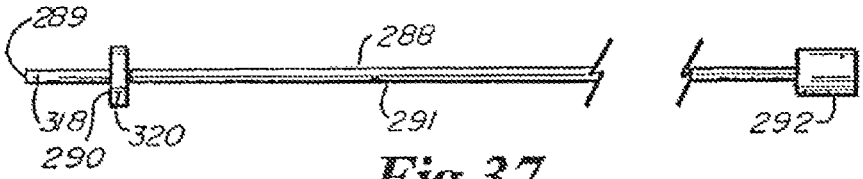
FIG. 37 is a ramrod according to an embodiment of the invention.
Figure 38A:
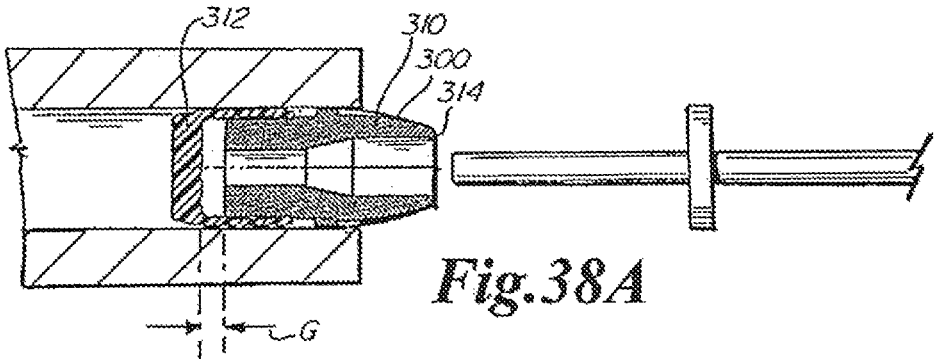
FIG. 38A is a cross sectional view of a projectile being inserted in a muzzleloader.
Figure 38B:
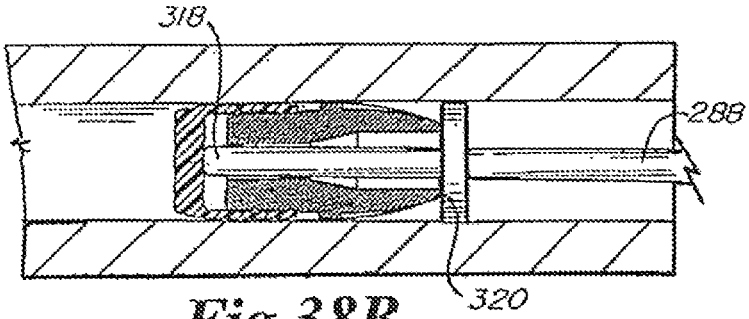
FIG. 38B is a cross sectional view of a projectile being inserted in a muzzleloader in an axially elongated state by a ramrod the maintains the elongated state.
Figure 38C:
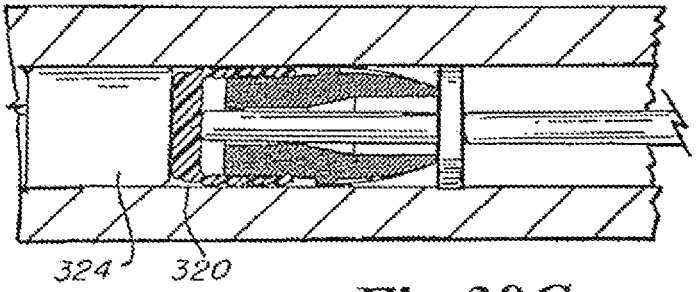
FIG. 38C is a cross sectional view of a projectile being seated in a muzzleloader in an axially elongated state by a ramrod the maintains the elongated state.

Referring to FIGS. 37-38C, a ramrod 288 has a pair of stop surfaces 289, 290, a shaft 291, and a handle 292. The projectile 300 has bullet body 310 and a cup portion 312, the cup portion slidably engaged on the bullet body. In order to maintain the gap G between the cup and bullet body, the ramrod engages both the cup portion 312 and the tip 314 of the bullet body 310 by respective engagement portions 318, 320 when the ramrod is pushing the projectile in the barrel, as illustrated by FIGS. 38B and 38C. In FIG. 38C the projectile is seated at the seating position 320 next to the propellant 324. The projectile is thus positioned to be fired and moved from the axially extended position to the axially shortened position that will also expand the radius of the projectile.

Figure 39A:
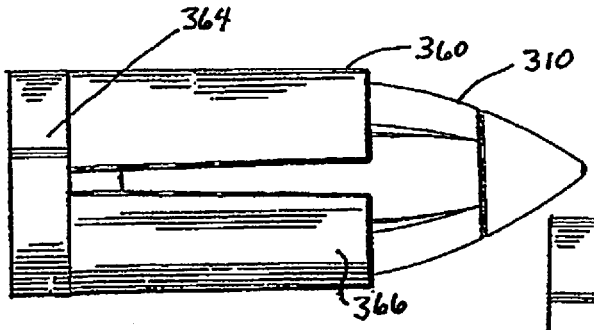
FIG. 39A is a saboted projectile according to embodiments of the invention in an axially elongated state.
Figure 39B:
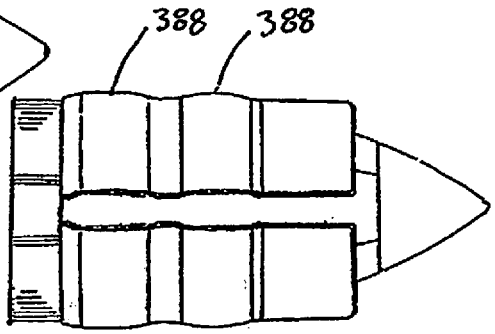
FIG. 39B is the saboted projectile of FIG. 39A in an axially shortened state affecting bulges.
Figure 40A:
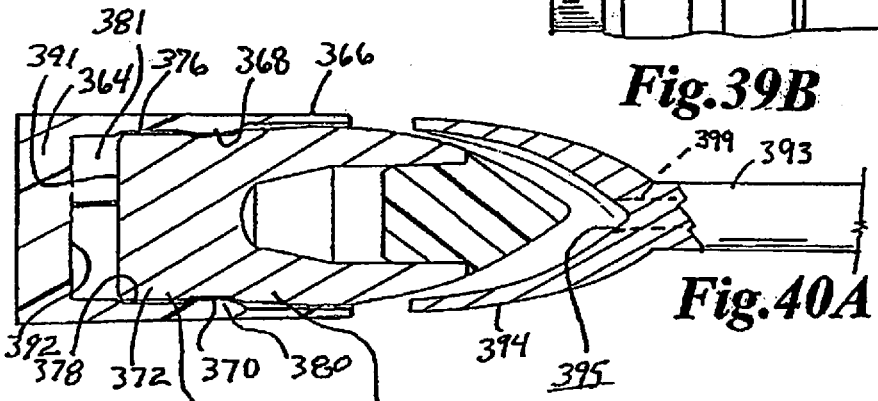
FIG. 40A is the projectile of FIG. 39A confronting a ramrod with capability of seating the projectile without shifting it to the axial shortened position.
Figure 40B:
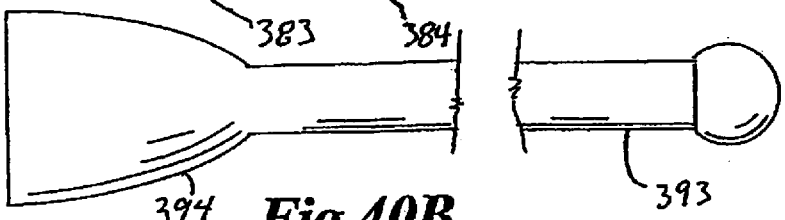
FIG. 40B is a side elevational view of a ramrod.

Referring to FIGS. 39A, 40A, and 40B, a saboted projectile with aspects of the invention are illustrated. Specifically, the saboted projectile has an axially elongated or extended position as shown in FIGS. 39A and 40A and an axially shortened position as shown in FIG. 39B. A cup 360, termed a sabot in that it separates from the projectile upon exiting the barrel, is engaged
with a projectile body 310. The sabot has a base portion 364 and a plurality of forward extending wings or fingers 366 that are unitary with the base portion. Internally, the sabot has an inwardly extending annular ridge 368 that seats within an circumferential recess 370 on the tail portion 372 of the projectile body. Additionally an outwardly extending circumferential projection 376 on the tail of the bullet body seats in a recess 378 in the sabot. In this configuration the thickened portions 380 of the fingers that initially seat in recesses or a projectile void 381 then ride up widened portions 383, 384 of the projectile body providing radially expanded portions 388 configured as bands on the sabot. The projectile body and sabot have confronting hard stops 391, 392 to definitively seat the projectile in the second position, the axially shortened position.

Figure 40C:
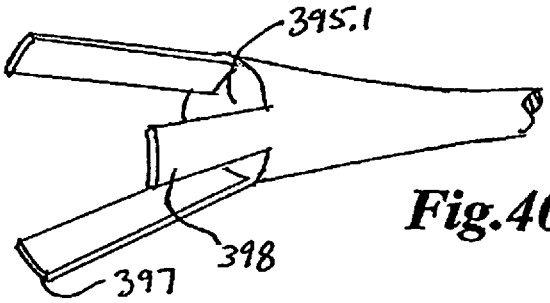
FIG. 40C is another embodiment of a ramrod according to an invention.

Referring to FIGS. 40A-40C, ramrod configurations suitable for saboted projectiles such as illustrated in FIGS. 39A-40A. The ramrod 393 of FIGS. 40A and 40B has a cup portion 394 with a bullet tip engagement portion 395. The ramrod 396 of FIG. 40C has cup/sabot engagement portions 397 on fingers 398. Similar to the ramrod of FIGS. 37-38C, the ramrods two engagement portions simultaneously engage and push down the barrel the projectile body and the cup. The dashed lines in FIG. 40A indicate that a central rod 399 may be slidable in the shaft to engage the tip of the projectile body to axially shorten the projectile after it is seated. This facilitates pushing the projectile down the barrel at the radially reduced configuration and then radially expanding the projectile once it is seated before it is fired.

Figure 41:
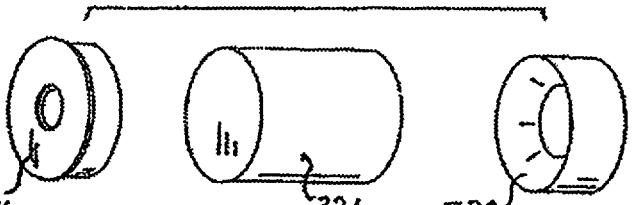
FIG. 41 illustrates components of the barrel assembly of FIG. 42A including propellant package and a primer retainer piece
Figure 42A:
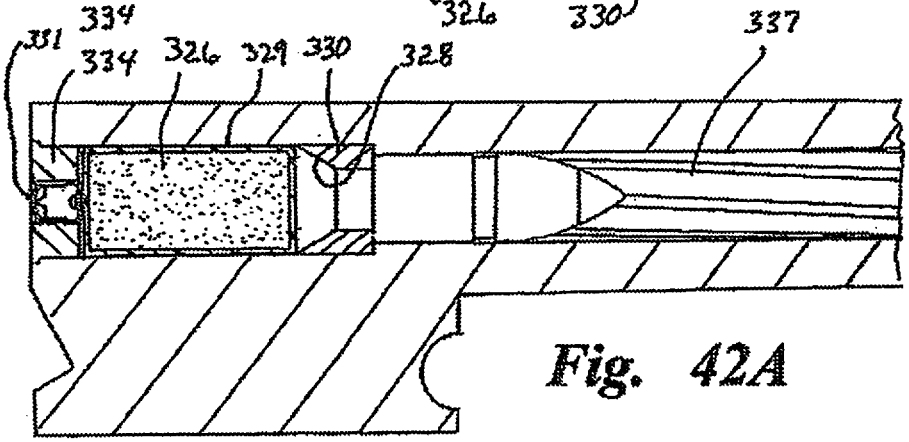
FIG. 42A is a cross section of a barrel assembly with a projectile in place.
Figure 42B:
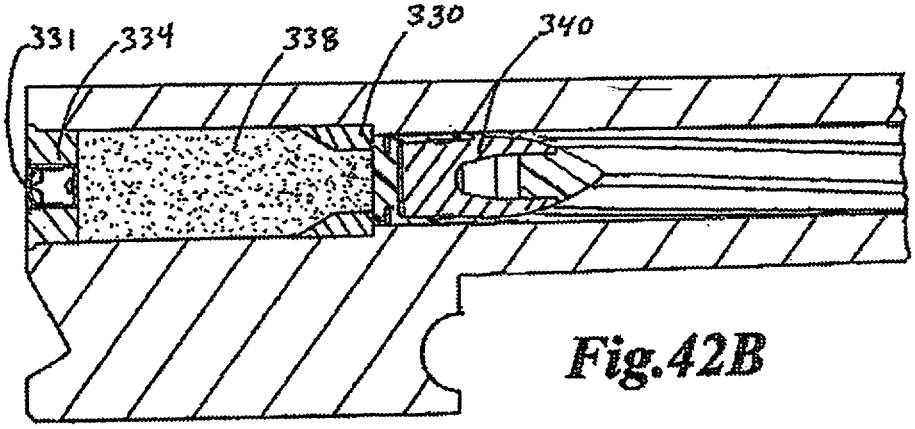
FIG. 42B is a cross section of a barrel assembly with a projectile seated and in its axial shortened position thereby better securing the bullet in place, and a propellant powder in the breech cavity, retained by the primer retainer. The securement of the projectile provides a secure containment for the powder propellant.

Referring to FIGS. 41 to 42B, two alternative embodiments are illustrated in which the propellant package is a discrete packet 326 in FIGS. 41 and 42A. The separator 330 is a constriction portion with a conical surface 328 facing the breech chamber 329. The primer 331 is secured in a primer retainer 334 that fits into the breech chamber. The fit can be snug and it may be held in place by the hammer receiver portion 58 of the gun when closed. The packaging for the packet can be, for example, polymer sheet material formed in a cylindrical shape, or materials also are suitable. As an alternative to the propellant powder, propellant pellets may also be used in the same manner, although the constriction portion can be sized, or the pellets sized to prevent their passage out of the breech chamber into the projectile bore.

FIG. 42B illustrates usage of the primer retainer 334 and the non-packaged propellant 338 in the breech chamber. The chamber may be contained on the projectile bore 337 side, opposite the constriction portion 330, by the projectile 342. The projectile as illustrated is in the axial shortened position causing the radial expansion thereby securing the projectile in the projectile seat 342 at the constriction portion 330. The projectile can be shortened with a radius increase by the user axially compressing the projectile with the ramrod.

Figure 42C:
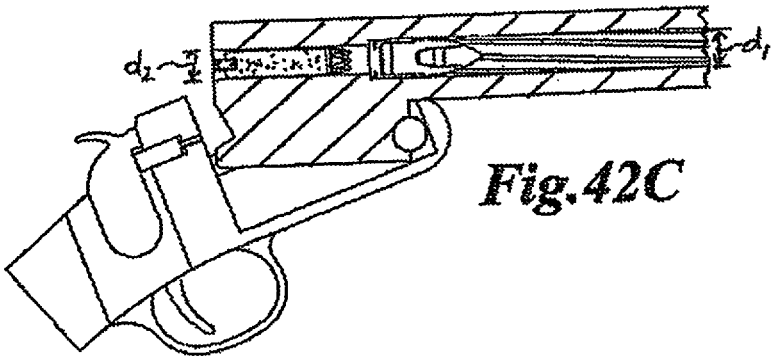
FIG. 42C is a cross section of a barrel assembly with a projectile in place and without a constrictor portion that narrows the breech, rather relying on the larger diameter of the barrel compared to the breech to prevent breech loading of the projectile.

FIG. 42C illustrates an embodiment with the projectile bore portion of the barrel having a diameter d1 greater than the diameter d2 of the breech chamber. This precludes loading of the projectiles sized for the projectile bore portion through the breech chamber.

Figure 43A:
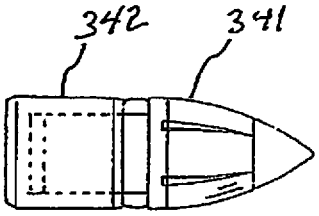
FIGS. 43A-43C illustrate an axially shiftable components with respect to one another of a projectile that affects a radial expansion.
Figure 43B:
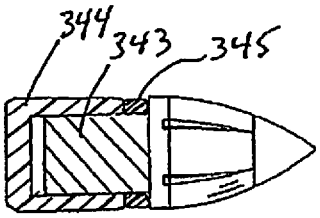
Figure 43C:
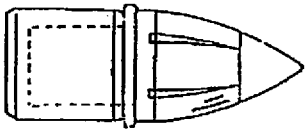

FIGS. 43A-43C illustrate another embodiment where a projectile 341 has an axial elongated position and an axially shortened position shown in FIG. 43C. In this embodiment, an axially sliding component 342, shaped as a cup, slides on the tail 343 of the projectile body 344 to affect the axial compression of a ring shaped polymer member 345 that is essentially incompressible from a volumetric perspective. The polymer member expands radially when compressed axially as it is constrained by the tail 343. The polymer member may be elastomeric or may be formed of more than one component, for example, that is an outer skin and a different inner material, for example a gel material constrained by an impervious polymer material.

Figure 44A:
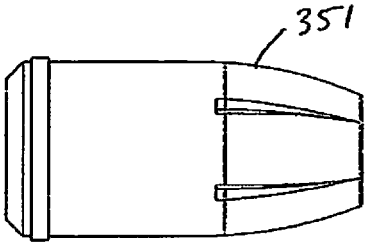
FIGS. 44A-44C illustrate an axially shiftable components with respect to one another of a projectile that affects a radial expansion
Figure 44B:
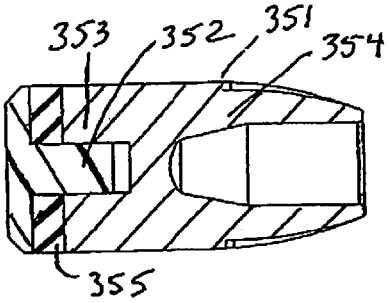
Figure 44C:
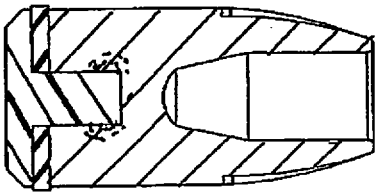

FIGS. 44A-44C illustrate another embodiment where a projectile 351 has an axial elongated position in FIG. 44B and an axially shortened position shown in FIGS. 44A and 44C. In this embodiment, an axially sliding component 352, having a T-shape in cross section, slides in a recess of the tail portion 353 of the projectile body 354 to affect the axial compression of a ring shaped polymer member 355 that is essentially incompressible from a volumetric perspective. The polymer member expands radially when compressed axially as it is constrained by the tail 353 and T-shaped member 252. The dashed lines in FIG. 44C indicate that the T-shaped member may have structure to cooperate with the recess to lock the projectile in the axial shortened position. A circumferential rib that is slid into a matching recess in the tail recess would accomplish such a locking. The polymer member may be elastomeric or may be formed of more than one component, for example, an outer skin and a different inner material, for example a gel material constrained by an impervious polymer material.

Figure 46:
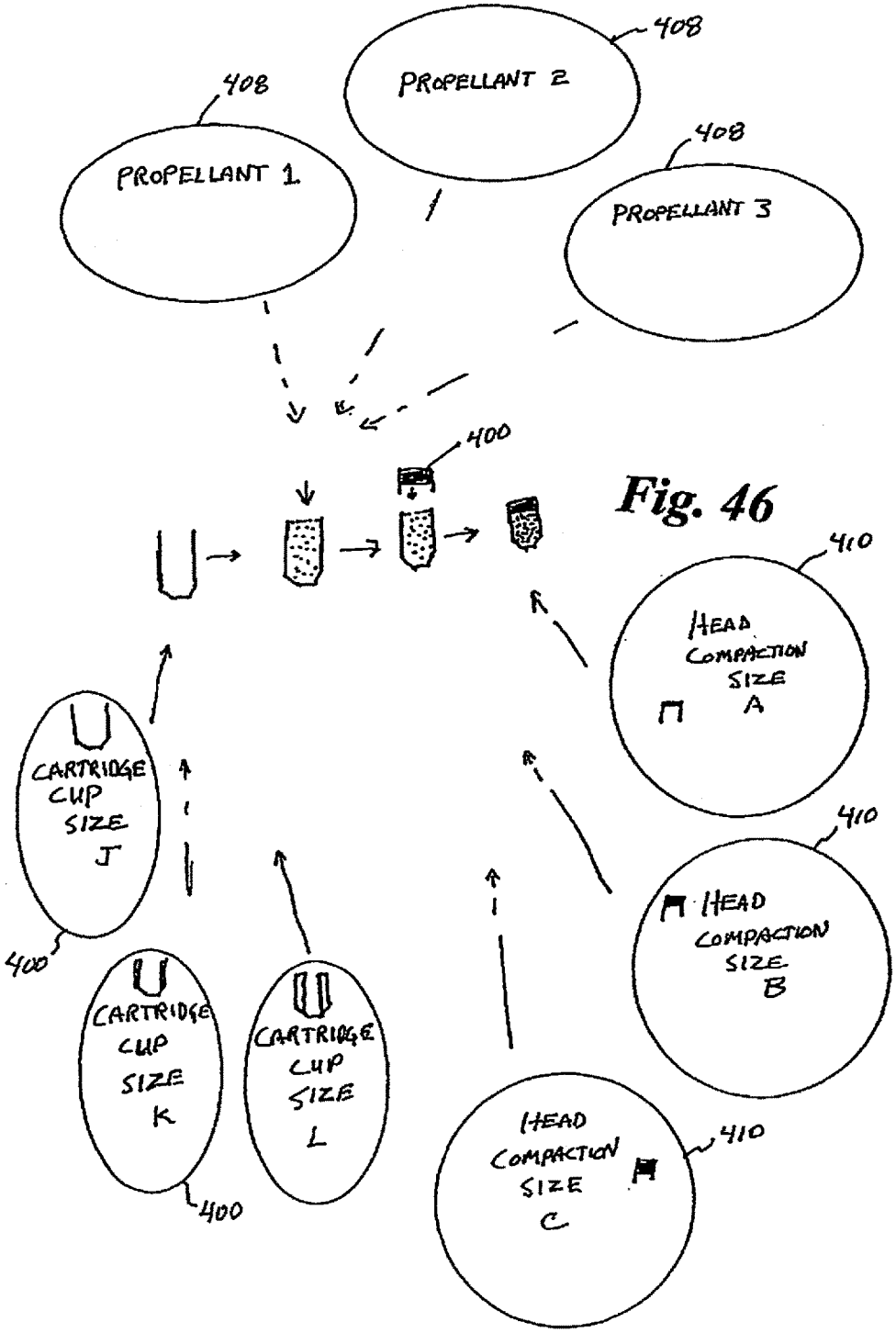
FIG. 46 is a diagrammatic view of a method of assembling a propellant cartridge for a muzzleloader.

FIGS. 45 and 46 illustrate embodiments of a manufacturing system conducive to use with the muzzleloading propellant cartridges described herein, particularly those cartridges shown in FIGS. 20-25, and 35-35B. First, a size of a cartridge cup is selected from a plurality of stockpiles 400 of various sizes of the cartridge cups that corresponds to a specific volumetric quantity of propellant. As shown in FIG. 46, the "J" size reflecting the minimal side wall thickness of the illustrated options that corresponds to the maximal volumetric capacity of the three sizes illustrated and identified as J, K, and L. A specific propellant having desired characteristics is then selected and the cartridge is then filled from the specific one of the plurality of reservoirs 408 corresponding to the selected propellant. Then, a specific compaction level is selected and the head with the specific sized volumetric displacement portion corresponding to the compaction level is selected from the stockpiles 410 of the cartridge heads. The selected head is then assembled on to the cartridge cup with corresponding selected compaction of the propellant and the head is secured thereon providing the cartridge. The methodology as illustrated is particularly suitable for muzzleloading propellant cartridges where compaction of the propellant can provide enhanced burn characteristics, which is generally contrary to traditional loading of propellants in firearm cartridges. Of course, different methodologies of assembling the propellant cartridges do not require all of the above steps. For example, the step of selecting the particular cartridge cup size could eliminated from a particular method. Similarly, selecting the head compaction size could be eliminated in a particular methodology. The above methodologies are suitable for instituting in a factory setting to provide a variety of propellant cartridges with different performance characteristics.

As used herein, propellant and propellant charges can be any propellant suitable for muzzleloader firing, including, propellant powder, flakes, and propellant pellets. The cartridge cups are illustrated as having a cylindrical exterior and interior walls but it is recognized that other shapes, in a cross section perpendicular to the cartridge cup axis, such as regular polygons, are also suitable and the inventions herein are not limited to circular tubular cartridge configurations unless specifically claimed.

While the invention is amenable to various modifications and alternative forms, specifics thereof have been depicted by way of example in the drawings and described in detail. It is understood, however, that the intention is not to limit the invention to the particular embodiments described. On the contrary, the intention is to cover all modifications, equivalents, and alternatives falling within the spirit and scope of the invention as defined by the appended claims.

The above references in all sections of this application are herein incorporated by references in their entirety for all purposes.

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment (s). The invention extends to any novel one, or any novel combination, of the features disclosed in this specification (including any incorporated by reference references, any accompanying claims, abstract and drawings), or to any novel one, or any novel combination, of the steps of any method or process so disclosed. The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

The invention claimed is:

1. A muzzleloader firing system comprising muzzleloader having a barrel with a breech chamber open rearwardly, a constriction portion at a forward end of the breech chamber, and a projectile bore portion with a bore forward of the constriction portion, the system further comprising a muzzleloader propellant cartridge without a projectile therein, the propellant cartridge sized for being received by the breech end of the muzzleloader, the cartridge comprising:

a cartridge cup portion comprising a polymer and having a tubular wall portion and a closed end of the tubular wall with a converging portion unitary with the tubular wall portion, the cup portion defining an interior;

a head portion connecting with the tubular wall portion of the cup portion, the head portion having a primer centrally engaged in the head portion; and propellant filling the interior and extending to the closed end;

the system further comprising a projectile sized to the barrel and further sized to not pass through the constriction portion.

2. The system of claim 1 wherein the cup portion closed end has a conical portion and a portion extending perpendicular to an axis of the cartridge.

3. The system of claim 1, wherein the cartridge cup portion closed end is rounded.

4. The system of claim 2 wherein an angle measured in an axial plane from the outside surface of the tubular portion to the outside surface of the conical portion is from 115 degrees to 155 degrees.

5. The system of claim 1, wherein the cartridge cup portion is injection molded.

6. A muzzleloader firing system comprising a muzzleloader having a barrel with a breech chamber open rearwardly, a constriction portion at a forward end of the breech chamber, and a projectile bore portion with a bore forward of the constriction portion, a hermetically sealed propellant cartridge having propellant therein and not having a projectile therein and having a closed and unitary polymer cup sized for conforming to the surface of the constriction portion facing the breech end, the system further comprising a projectile for loading in the muzzle end, the projectile being received forward of the constriction portion wherein the projectile comprises a bullet body and a cup portion engaged on the body.

7. A muzzleloader firing system comprising a muzzleloader having a barrel with a breech chamber open rearwardly, a constriction portion at a forward end of the breech chamber, and a projectile bore portion with a bore forward of the constriction portion, a hermetically sealed propellant cartridge having propellant therein and not having a projectile therein and having a closed and unitary polymer cup sized for conforming to the surface of the constriction portion facing the breech end, the system further comprising a projectile for loading in the muzzle end, the projectile being received forward of the constriction portion further comprising a ramrod having two engagement portions, one for the projectile bullet body and one for the cup portion.

8. A muzzleloader firing system comprising a muzzleloader having a barrel with a breech chamber open rearwardly, a constriction portion at a forward end of the breech chamber, and a projectile bore portion with a bore forward of the constriction portion, a hermetically sealed propellant cartridge having propellant therein and not having a projectile therein and having a closed and unitary polymer cup sized for conforming to the surface of the constriction portion facing the breech end, the system further comprising a projectile for loading in the muzzle end, the projectile being received forward of the constriction portion wherein the propellant cartridge has a head portion that conforms and is secured to the cup portion, the head portion having an end flange and a recess for a primer.

9. A muzzleloader firing system comprising a muzzleloader having a barrel with a breech chamber open rearwardly, a constriction portion at a forward end of the breech chamber, and a projectile bore portion with a bore forward of the constriction portion, a hermetically sealed propellant cartridge having propellant therein and not having a projectile therein and having a closed and unitary polymer cup sized for conforming to the surface of the constriction portion facing the breech end, the system further comprising a projectile for loading in the muzzle end, the projectile being received forward of the constriction portion wherein the surface of the constriction portion facing the muzzle end is perpendicular to an axis of the barrel of the muzzleloader.

10. A muzzleloader firing system comprising a muzzleloader having a barrel with a breech chamber open rearwardly, a constriction portion at a forward end of the breech chamber, and a projectile bore portion with a bore forward of the constriction portion, a hermetically sealed propellant cartridge having propellant therein and not having a projectile therein and having a closed and unitary polymer cup sized for conforming to the surface of the constriction portion facing the breech end, the system further comprising a projectile for loading in the muzzle end, the projectile being received forward of the constriction portion wherein the constriction portion is a singular piece and is removable from the muzzleloader.

11. The muzzleloader firing system of claim 8 wherein a primer is received in the recess for the primer.

12. A muzzleloader firing system comprising a muzzleloader having a barrel with a breech chamber open rearwardly, a constriction portion at a forward end of the breech chamber, and a projectile bore portion with a bore forward of the constriction portion, a hermetically sealed propellant cartridge having propellant therein and not having a projectile therein and having a closed and unitary polymer cup sized for conforming to the surface of the constriction portion facing the breech end, the system further comprising a projectile for loading in the muzzle end, the projectile being received forward of the constriction portion wherein the cup portion and head portion define an interior and exclusively propellant fills the interior and extends to the forward end of the cup portion.

13. A muzzleloader firing system comprising muzzleloader having a barrel with a breech chamber, a constriction portion and a projectile bore portion with a bore, the constriction portion having a surface facing a breech end and a surface facing a muzzle end, a plurality of hermetically sealed projectileless propellant cartridges each having a head end connecting to cup, the head end having a recess for a primer, the system further comprising a projectile for insertion in the muzzle end and wherein the diameter of the bore of the projectile bore portion is greater than a minimal diameter of the constriction portion.

14. The muzzleloader firing system of claim 13 wherein the projectile comprises a bullet body and a cup portion engaged on the body.

15. The muzzleloader firing system of claim 13, wherein the cup portion is polymer and has a frusto conical portion.

16. The muzzleloader firing system of claim 13, wherein the muzzleloader breaks open with a stock, trigger, and firing pin pivoting to allow access to the breech chamber for loading the hermetically sealed projectileless propellant cartridges.

17. The muzzleloader firing system of claim 13 wherein a propellant cartridge having a polymer cup with a conical surface conforming to the surface of the constriction portion facing the breech end, and further comprising a projectile, the projectile having an end surface conforming to the constriction surface facing the muzzle end.

18. The muzzleloader firing system of claim 14 wherein the surface of the constriction portion facing the muzzle end is perpendicular to an axis of the barrel of the muzzleloader.

* * * * *